US011303014B2

(12) United States Patent
Lim et al.

(10) Patent No.: US 11,303,014 B2
(45) Date of Patent: Apr. 12, 2022

(54) ELECTRONIC DEVICE INCLUDING ANTENNA MODULE

(71) Applicant: SAMSUNG ELECTRONICS CO., LTD., Suwon-si (KR)

(72) Inventors: Jinho Lim, Suwon-si (KR); Yonghwa Kim, Suwon-si (KR); Jungsik Park, Suwon-si (KR); Hyunmi Cheong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 197 days.

(21) Appl. No.: 16/716,063

(22) Filed: Dec. 16, 2019

(65) Prior Publication Data

US 2020/0194879 A1 Jun. 18, 2020

(30) Foreign Application Priority Data

Dec. 14, 2018 (KR) ..... 10-2018-0162269

(51) Int. Cl.
*H01Q 1/38* (2006.01)
*H01Q 1/02* (2006.01)
*H01Q 1/24* (2006.01)

(52) U.S. Cl.
CPC ..... *H01Q 1/38* (2013.01); *H01Q 1/02* (2013.01); *H01Q 1/243* (2013.01)

(58) Field of Classification Search
CPC ..... H01Q 1/38; H01Q 1/02; H01Q 1/243; H01Q 1/1207; H01Q 21/08; H01Q 9/0407; H04M 1/0249; H04B 1/40
See application file for complete search history.

(56) References Cited

U.S. PATENT DOCUMENTS 8,844,893 B2 9/2014 Spagnolo et al.
2020/0106167 A1* 4/2020 Moon ..... H04M 1/026
2020/0287268 A1* 9/2020 Moon ..... H01Q 1/243

FOREIGN PATENT DOCUMENTS

KR 10-2010-0099390 9/2010
KR 10-2013-0040616 4/2013
KR 10-2013-0093595 8/2013

* cited by examiner

*Primary Examiner* — David E Lotter
(74) *Attorney, Agent, or Firm* — Nixon & Vanderhye P.C.

(57) ABSTRACT

Disclosed is an electronic device. The electronic device includes a housing that includes a first plate facing a first direction, a second plate facing a second direction opposite the first direction, and a side housing surrounding a space between the first plate and the second plate, wherein the second plate includes an outer surface facing the second direction and being substantially flat and an inner surface facing the first direction and being substantially flat, an inner plate interposed between the first plate and the second plate, wherein the inner plate includes a surface facing the inner surface of the second plate and an opening, an antenna structure comprising a substrate including a first surface facing the inner surface of the second plate and a second surface facing away from the inner surface, at least one conductive pattern on the first surface and/or embedded in the substrate, a surrounding portion including a hole penetrating the second surface, the antenna structure being disposed in the opening, and a support coupler including a protrusion extending to an interior of the hole.

20 Claims, 26 Drawing Sheets

ELECTRONIC DEVICE INCLUDING ANTENNA MODULE

CROSS-REFERENCE TO RELATED APPLICATION

This application is based on and claims priority under 35 U.S.C. § 119 to Korean Patent Application No. 10-2018-0162269, filed on Dec. 14, 2018, in the Korean Intellectual Property Office, the disclosure of which is incorporated by reference herein its entirety.

BACKGROUND

1. Field

The disclosure relates to an electronic device including an antenna module.

2. Description of Related Art

Because an antenna operates at a relatively low frequency (e.g., 3 GHz or lower), the antenna utilizes a metal material of a housing as a radiator. However, this manner fails to be applied to an antenna that operates at a high frequency (e.g., 6 GHz or higher) having the strong straightness. An antenna that operates at a relatively high frequency may be mounted within an electronic device as a separate module.

A radio frequency (RF) signal that is radiated from an antenna module may be radiated through a back cover rather than a front surface on which a display is disposed. As the antenna module is adjacent to the back cover, it is advantageous for radiation performance of the antenna module. Also, the antenna module may be disposed between an inner structure of the housing and the back cover so as to be pressed toward the back cover. To prevent the antenna module from moving toward the back cover, a fixing structure of an electronic device may be formed between the back cover and the antenna module.

Because a portion of a structure for fixing the antenna module is formed on a front surface of the antenna module, it may be difficult to secure a distance between a front surface and a back surface of the antenna module. Also, in the case of fixing the back surface of the antenna module with a tape or fixing the antenna module in a bonding manner, as time goes on, the adhesion of the tape may decrease, or the bonding may be melt (or fused) by the generated heat. In this case, the antenna module may move. The above fixing structures may have an influence on the radiation performance.

The above information is presented as background information only to assist with an understanding of the disclosure. No determination has been made, and no assertion is made, as to whether any of the above might be applicable as prior art with regard to the disclosure.

SUMMARY

Embodiments of the disclosure address at least the above-mentioned problems and/or disadvantages and to provide at least the advantages described below. Accordingly, an example aspect of the disclosure is to provide an electronic device capable of fixing an antenna module such that a given distance between the antenna module and a back cover is maintained.

In accordance with an example aspect of the disclosure, an electronic device may include a housing including a first plate facing a first direction, a second plate facing a second direction opposite the first direction, and a side housing surrounding a space between the first plate and the second plate, wherein the second plate includes an outer surface facing the second direction and being substantially flat and an inner surface facing the first direction and being substantially flat, an inner plate interposed between the first plate and the second plate, wherein the inner plate includes a surface facing the inner surface of the second plate and an opening, an antenna structure comprising a substrate including a first surface facing the inner surface of the second plate and a second surface facing away from the inner surface, at least one conductive pattern formed on the first surface of the antenna structure and/or embedded in the substrate, a first surrounding portion of the substrate including a first hole penetrating the second surface, and a second surrounding portion of the substrate including a second hole penetrating the second surface, the antenna structure being disposed in the opening, a first supporting coupler including a first portion, of which at least a portion is located between the first surrounding portion and the first plate, the first supporting coupler including a first protrusion extending to an interior of the first hole, a second supporting coupler including a second portion, of which at least a portion is located between the second surrounding portion and the first plate, the second supporting coupler including a second protrusion extending to an interior of the second hole, and a wireless communication circuit that is electrically connected to the conductive pattern and is mounted on the second surface.

In accordance with another example aspect of the disclosure, an electronic device may include a housing including a first plate facing a first direction, a second plate facing a second direction opposite the first direction, and a side housing surrounding a space between the first plate and the second plate, wherein the second plate includes an outer surface facing the second direction and being substantially flat and an inner surface facing the first direction and being substantially flat, an inner plate interposed between the first plate and the second plate, wherein the inner plate includes a surface facing the inner surface of the second plate and an opening, an antenna structure comprising a substrate including a first surface facing the inner surface of the second plate and a second surface facing away from the inner surface, at least one conductive pattern formed on the first surface and/or embedded in the substrate, and at least one hole penetrating the second surface, the antenna structure being disposed in the opening, at least support coupler including a first portion at least partially located between the substrate and the first plate and a protrusion extending to an interior of the hole, and a wireless communication circuit that is electrically connected to the conductive pattern and is mounted on the second surface.

In accordance with another example aspect of the disclosure, an electronic device may include a housing including a first plate, a second plate facing away from the first plate, and a side housing surrounding a space between the first plate and the second plate, and an antenna substrate comprising a first portion including a conductive pattern, a first surface where an RF signal is radiated by the conductive pattern, and a second surface facing away from the first surface, a second portion at at least a portion of an edge of the first portion in which a first hole is formed, and a third portion at at least a portion of an edge of the first portion in which a second hole is formed. The side housing may include a first surface facing the first plate, a second surface facing the second plate, and a recess on the second surface.

The recess may include a first inner side wall, and a second inner side wall facing the first inner side wall and located closer to an inside of the housing than the first inner side wall. The electronic device may further include a coupler configured to fix the antenna substrate in the recess such that the first surface of the antenna substrate faces the first inner side wall and the second surface of the antenna substrate faces the second inner side wall. The coupler may include a first coupler including a fixing portion fixed to a first surrounding portion of the recess and facing the second plate, an extension portion extending from the fixing portion to an interior of the recess and facing the first inner side wall, and a first protrusion protruding from the extension portion in a direction facing the first inner side wall and inserted into the first hole of the antenna substrate, and a second coupler including a fixing portion fixed to a second surrounding portion of the recess and facing the second plate, an extension portion extending from the fixing portion to the interior of the recess and facing the first inner side wall, and a second protrusion protruding from the extension portion in a direction facing the first inner side wall and inserted into the second hole of the antenna substrate.

In accordance with another example aspect of the disclosure, an electronic device may include a housing including a first plate, a second plate facing the first plate, and a side housing surrounding a space between the first plate and the second plate, a printed circuit board disposed in the space, and an antenna module including an antenna substrate and a wireless communication circuit. The antenna substrate may include a first surface including a radiation region where an RF signal is radiated, a second surface facing away from the first surface in which a coupling hole is formed, and a conductive pattern defining the radiation region. The wireless communication circuit may be disposed on the second surface of the antenna substrate and may be electrically connected with the conductive pattern. The antenna substrate may include an antenna module comprising at least one antenna disposed between the printed circuit board and the second plate such that the first surface faces the second plate and the second surface faces the printed circuit board, and a coupler disposed on the printed circuit board. The coupling coupler may be coupled to the antenna module and may include a protrusion inserted into the coupling hole formed on the second surface of the antenna substrate.

In accordance with another example aspect of the disclosure, an electronic device may include a housing including a first plate, a second plate facing away from the first plate, and a side housing surrounding a space between the first plate and the second plate, an antenna substrate including a conductive pattern, a first surface where an RF signal is radiated by the conductive pattern, a second surface facing away from the first surface, and a third surface between the first surface and the second surface, and a bracket configured to fix the antenna substrate to the side housing, the side housing may include a first surface facing the first plate, a second surface facing the second plate, and a recess on the second surface, the recess may include a first inner side wall, and a second inner side wall facing the first inner side wall and closer to an inside of the housing than the first inner side wall, the antenna substrate may be disposed in the recess such that the first surface faces the first inner side wall, the second surface faces the second inner side wall, and the third surface faces the second plate, and the bracket may include an insertion portion inserted between the second surface of the antenna substrate and the second inner side wall, a support portion extending from the insertion portion and covering at least a portion of the third surface of the antenna substrate, and a fixing portion extending from the support portion and fixed to the second surface of the side member.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the present disclosure will be more apparent from the following detailed description taken in conjunction with the accompanying drawings, in which.

With regard to description of drawings, similar components may be marked by similar reference numerals.

DETAILED DESCRIPTION

Hereinafter, various example embodiments of the disclosure will be described in greater detail with reference to accompanying drawings. However, those of ordinary skill in the art will recognize that various modifications, equivalents, and/or alternatives on various example embodiments described herein can be variously made without departing from the scope and spirit of the disclosure.

Figure 1:
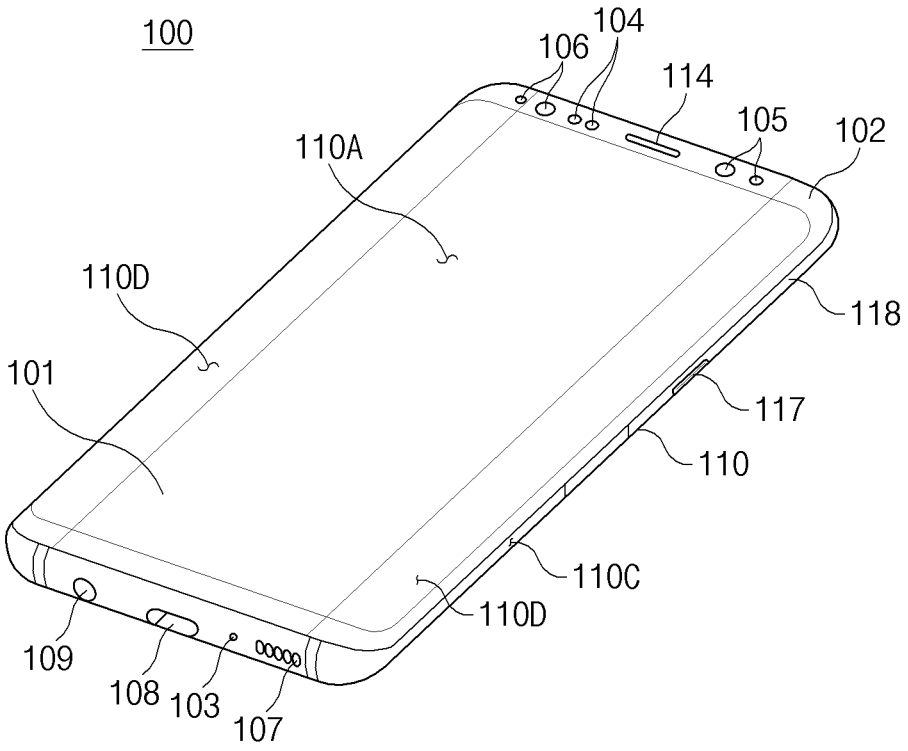
FIG. 1 is a front perspective view illustrating an example electronic device according to an embodiment.
Figure 2:
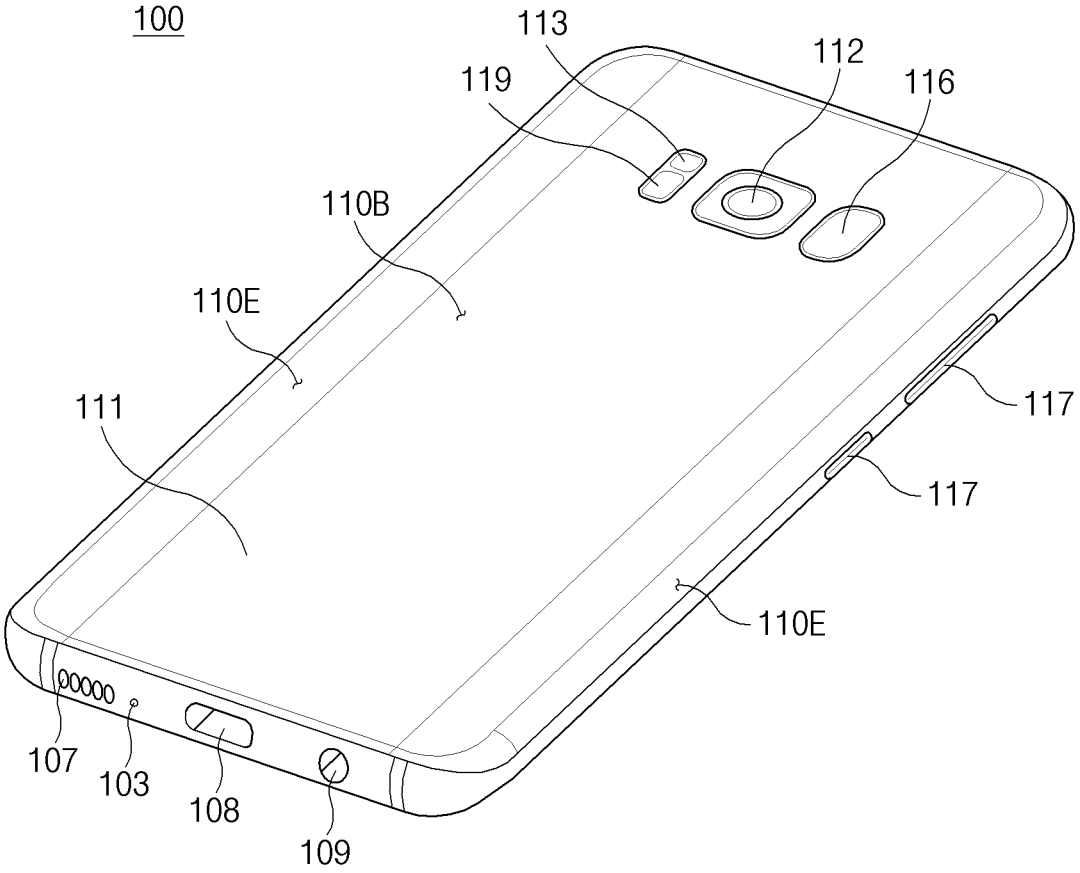
FIG. 2 is a rear perspective view of an example electronic device illustrated in FIG. 1 according to an embodiment.
Figure 3:
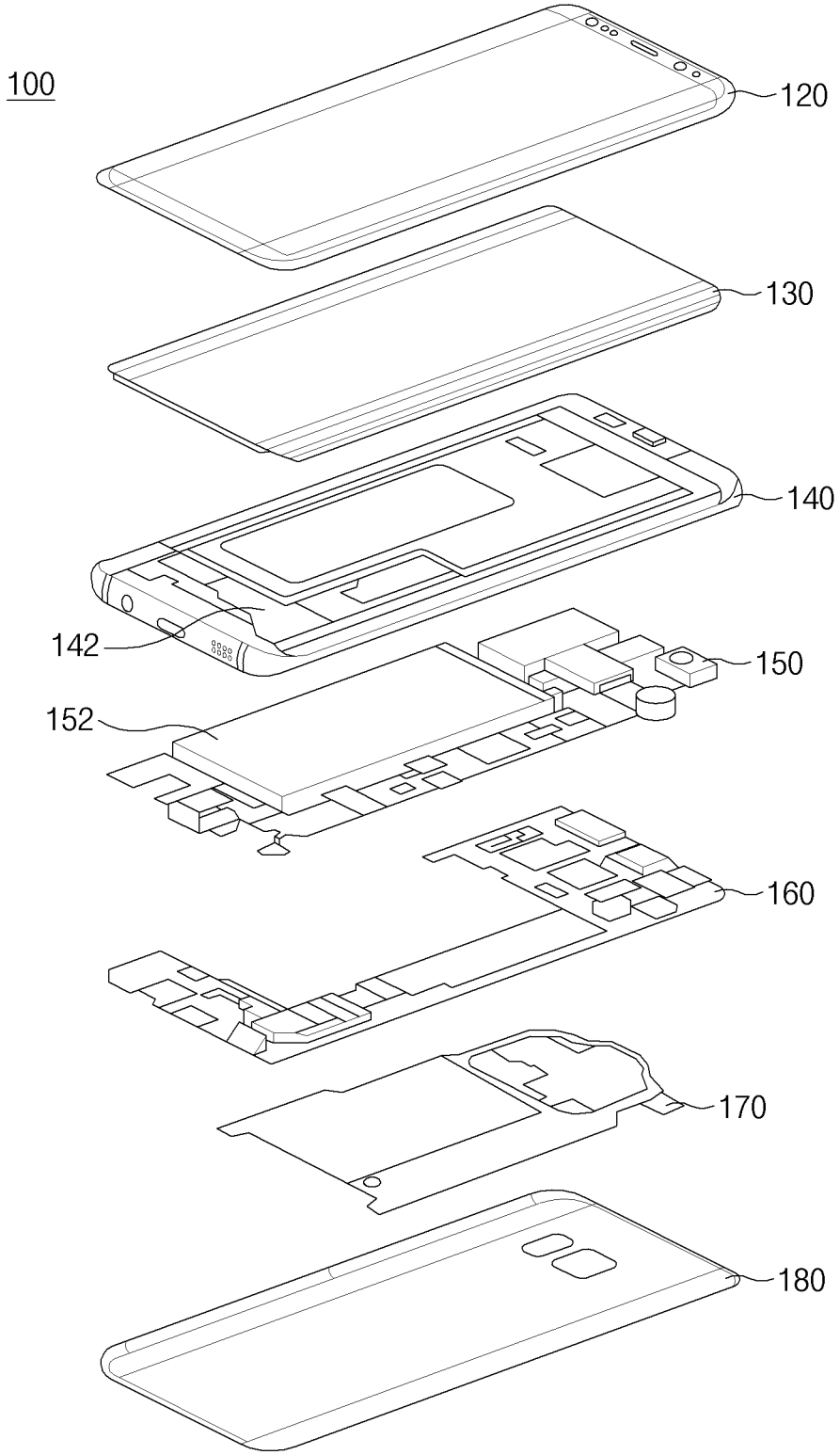
FIG. 3 is an exploded perspective view of an example electronic device illustrated in FIG. 1 according to an embodiment.

FIG. 1 is a front perspective view of an example electronic device according to an embodiment. FIG. 2 is a rear perspective view of an electronic device illustrated in FIG. 1. FIG. 3 is an exploded perspective view of an electronic device illustrated in FIG. 1.

Referring to FIGS. 1 and 2, an electronic device 100 according to an embodiment may include a housing 110 including a first surface (or a front surface) 110A, a second surface (or a back surface) 110B, and a side surface 110C surrounding a space between the first surface 110A and the second surface 110B. In another embodiment (not illustrated), a housing may be also referred to as a structure that forms a part of the first surface 110A, the second surface 110B, and the side surface 110C of FIG. 1. According to an embodiment, the first surface 110A may be implemented with a front plate 102 (e.g., a glass plate including various coating layers, or a polymer plate), of which at least a portion is substantially transparent. The second surface 110B may be implemented with a back plate 111 that is substantially opaque. For example, the back plate 111 may be implemented with a coated or colored glass, a ceramic, a polymer, a metal (e.g., aluminum, stainless steel (STS), or magnesium), or a combination of at least two of the materials. The side surface 110C may be coupled to the front plate 102 and the back plate 111 and may be implemented with a side bezel structure (or a "side member") 118 including a metal and/or a polymer. In an embodiment, the back plate 111 and the side bezel structure 118 may be integrally formed and may include the same material (e.g., a metal material such as aluminum).

In the embodiment that is illustrated, the front plate 102 may include two first regions 110D, which are bent toward the back plate 111 from the first surface 110A so as to be seamlessly extended, at opposite long edges of the front plate 102. In the embodiment (refer to FIG. 2) that is illustrated, the back plate 111 may include two second regions 110E, which are bent toward the front plate 102 from the second surface 110B so as to be seamlessly extended, at opposite long edges thereof. In an embodiment, the front plate 102 (or the back plate 111) may include only one of the first regions 110D (or the second regions 110E). In another embodiment, a portion of the first regions 110D or the second regions 110E may not be included. In the embodiments, when viewed from a side surface of the electronic device 100, the side bezel structure 118 may have a first thickness (or width) on one side where the first regions 110D or the second regions 110E are not included, and may have a second thickness, which is smaller than the first thickness, on one side where the first regions 110D or the second regions 110E are included.

According to an embodiment, the electronic device 100 may include at least one or more of a display 101, an audio module (103, 107, 114), a sensor module (104, 116, 119), a camera module (105, 112, 113), key input devices 117, a light-emitting device 106, and a connector hole (108, 109). In an embodiment, the electronic device 100 may not include at least one (e.g., the key input devices 117 or the light-emitting device 106) of the components or may further include any other component.

The display 101 may be exposed (e.g., viewable) through a considerable portion of the front plate 102, for example. In an embodiment, at least a portion of the display 101 may be exposed through the first surface 110A and the front plate 102 forming the first regions 110D of the side surface 110C. In an embodiment, a corner of the display 101 may be formed to be mostly identical to a shape of an outer portion of the front plate 102 adjacent thereto. In another embodiment (not illustrated), to increase the area where the display 101 is exposed, a distance between an outer portion of the display 101 and an outer portion of the front plate 102 may be formed mostly identically.

In another embodiment (not illustrated), a recess or an opening may be formed in a portion of a screen display region of the display 101, and at least one or more of the audio module 114, the sensor module 104, the camera module 105, and the light-emitting device 106 may be provided to be aligned with the recess or the opening. In another embodiment (not illustrated), at least one or more of the audio module 114, the sensor module 104, the camera module 105, the fingerprint sensor 116, and the light-emitting device 106 may be provided on a back surface of the display 101, which corresponds to the screen display region. In another embodiment (not illustrated), the display 101 may be combined with a touch sensing circuit, a pressure sensor capable of measuring the intensity (or pressure) of a touch, and/or a digitizer capable of detecting a magnetic stylus pen or may be disposed adjacent thereto. In an embodiment, at least a part of the sensor module (104, 119) and/or at least a part of the key input devices 117 may be disposed in the first regions 110D and/or the second regions 110E.

The audio module (103, 107, 114) may include a microphone hole 103 and a speaker hole (107, 114). A microphone for obtaining external sound may be disposed within the microphone hole 103; in an embodiment, a plurality of microphones may be disposed to make it possible to detect a direction of sound. The speaker hole (107, 114) may include an external speaker hole 107 and a receiver hole 114 for call. In an embodiment, the speaker hole (107, 114) and the microphone hole 103 may be implemented with one hole, or a speaker (e.g., a piezoelectric speaker) may be included without the speaker hole (107, 114).

The sensor module (104, 116, 119) may generate an electrical signal or a data value corresponding to an internal operation state of the electronic device 100 or corresponding to an external environment state. The sensor module (104, 116, 119) may include, for example, the first sensor module 104 (e.g., a proximity sensor) and/or a second sensor module (not illustrated) (e.g., a fingerprint sensor) disposed on the first surface 110A of the housing 110, and/or the third sensor module 119 (e.g., a hear rate monitor (HRM) sensor) and/or the fourth sensor module 116 (e.g., a fingerprint sensor) disposed on the second surface 110B of the housing 110. The fingerprint sensor may be disposed on the second surface 110B as well as the first surface 110A (e.g., the display 101) of the housing 110. The electronic device 100 may further include a sensor module not illustrated, for example, at least one of a gesture sensor, a gyro sensor, a barometric pressure sensor, a magnetic sensor, an acceleration sensor, a grip sensor, a color sensor, an infrared (IR) sensor, a biometric sensor, a temperature sensor, a humidity sensor, or an illumination sensor 104.

The camera module (105, 112, 113) may include the first camera device 105 disposed on the first surface 110A of the electronic device 100, and the second camera device 112 and/or the flash 113 disposed on the second surface 110B. The camera devices 105 and 112 may include one or more lenses, an image sensor, and/or an image signal processor. The flash 113 may include, for example, a light-emitting diode or a xenon lamp. In an embodiment, two or more lenses (e.g., infrared camera, wide-angle and telephoto lenses) and image sensors may be disposed on one surface of the electronic device 100.

The key input devices 117 may be disposed on the side surface 110C of the housing 110. In another embodiment, the electronic device 100 may not include all or a part of the key input devices 117, and a key input device not included may be implemented on the display 101 in the form of a soft key. In an embodiment, the key input device may include the sensor module 116 disposed on the second surface 110B of the housing 110.

The light-emitting device 106 may be disposed, for example, on the first surface 110A of the housing 110. The light-emitting device 106 may provide status information of the electronic device 100, for example, in the form of light. In another embodiment, the light-emitting device 106 may provide, for example, a light source that operates in conjunction with an operation of the camera module 105. The light-emitting device 106 may include, for example, a light-emitting diode (LED), an IR LED, and a xenon lamp.

The connector hole (108, 109) may include the first connector hole 108 that is able to accommodate a connector (e.g., a USB connector) for transmitting/receiving a power and/or data with an external electronic device, and/or the second connector hole (or an earphone jack) 109 that is able to accommodate a connector for transmitting/receiving an audio signal with the external electronic device.

Referring to FIG. 3, the electronic device 100 may include a side member (e.g., a side housing) 140, a first support member 142 (e.g., a bracket), a front plate 120, a display 130, a printed circuit board 150, a battery 152, a second support member 160 (e.g., a rear case), an antenna 170, and a back plate 180. In an embodiment, the electronic device 100 may not include at least one (e.g., the first support member 142 or the second support member 160) of the components or may further include any other component. At least one of the components of the electronic device 100 may be identical or similar to at least one of the components of the electronic device 100 of FIG. 1 or 2, and thus, additional description will be omitted to avoid redundancy.

The first support member 142 may be disposed within the electronic device 100 and may be connected with the side member 140, or may be integrally formed with the side member 140. The first support member 142 may be formed of, for example, a metal material and/or a nonmetal material (e.g., a polymer). The display 130 may be coupled to one surface of the first support member 142, and the printed circuit board 150 may be coupled to an opposite surface of the substrate 130. A processor, a memory, and/or an interface may be mounted on the printed circuit board 150. For example, the processor may include one or more of a central processing unit, an application processor, a graphic processing device, an image signal processor, a sensor hub processor, or a communication processor.

The memory may include, for example, a volatile memory or a nonvolatile memory.

The interface may include, for example, a high definition multimedia interface (HDMI), a universal serial bus (USB) interface, a secure digital (SD) card interface, and/or an audio interface. The interface may electrically or physically connect, for example, the electronic device 100 with an external electronic device and may include a USB connector, an SD card/MMC connector, or an audio connector.

The battery 152 that is a device for supplying a power to at least one component of the electronic device 100 may include, for example, a primary cell incapable of being recharged, a secondary cell rechargeable, or a fuel cell. At least a portion of the battery 152 may be disposed on substantially the same plane as the printed circuit board 150, for example. The battery 152 may be integrally disposed within the electronic device 100, or may be disposed to be removable from the electronic device 100.

The antenna 170 may be interposed between the back plate 180 and the battery 152. The antenna 170 may include, for example, a near field communication (NFC) antenna, an antenna for wireless charging, and/or a magnetic secure transmission (MST) antenna. For example, the antenna 170 may perform short range communication with an external device or may wirelessly transmit/receive a power necessary to charge. In another embodiment, an antenna structure may be implemented with a portion of the side member 140 and/or the first support member 142, or with a combination thereof.

Figure 4:
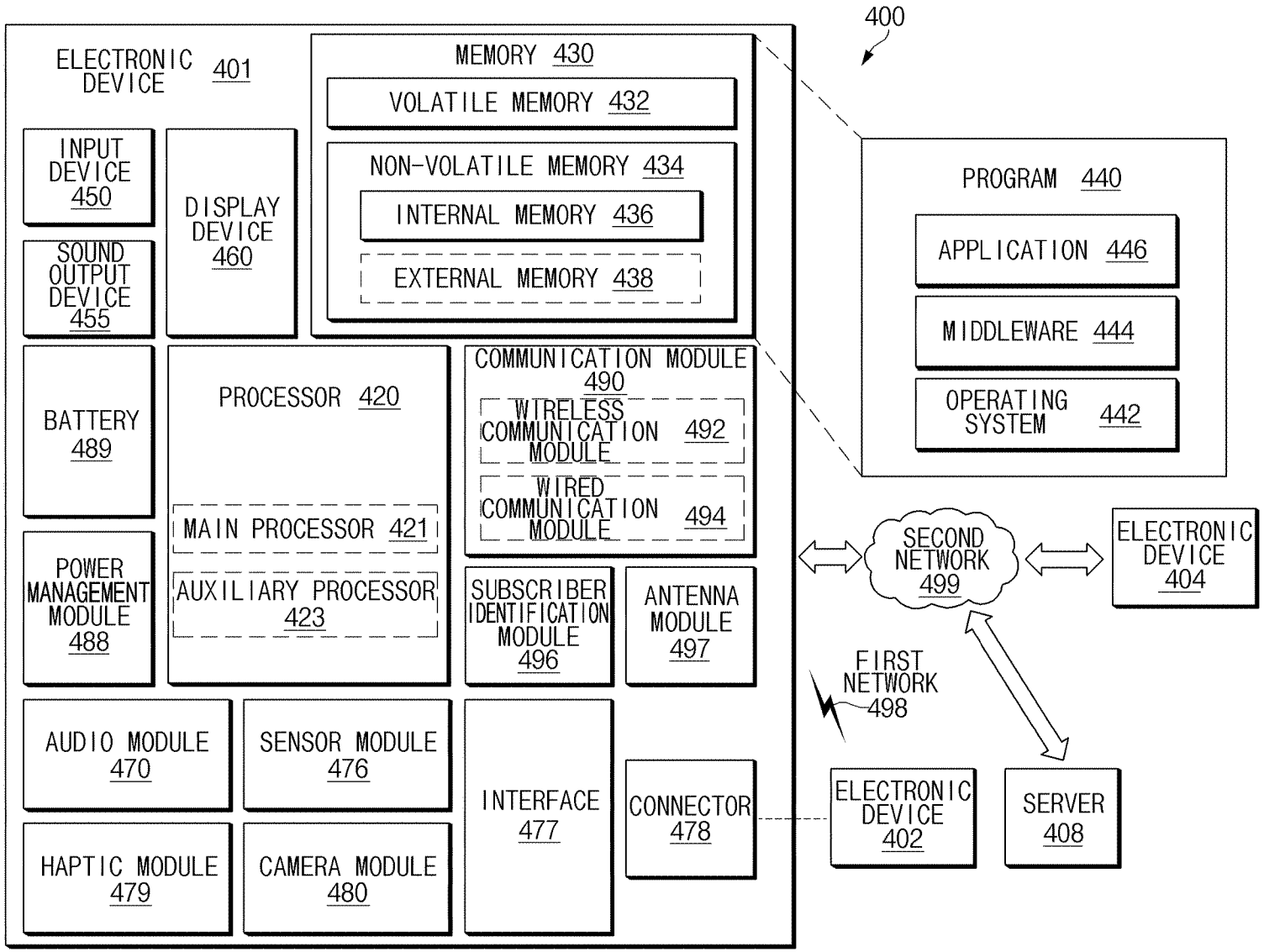
FIG. 4 is a block diagram illustrating an example electronic device in a network environment, according to various embodiments.

FIG. 4 is a block diagram illustrating an example electronic device 401 in a network environment 400 according to various embodiments. Referring to FIG. 4, the electronic device 401 in the network environment 400 may communicate with an electronic device 402 via a first network 498 (e.g., a short-range wireless communication network), or an electronic device 404 or a server 408 via a second network 499 (e.g., a long-range wireless communication network). According to an embodiment, the electronic device 401 may communicate with the electronic device 404 via the server 408. According to an embodiment, the electronic device 401 may include a processor 420, memory 430, an input device 450, a sound output device 455, a display device 460, an audio module 470, a sensor module 476, an interface 477, a haptic module 479, a camera module 480, a power management module 488, a battery 489, a communication module 490, a subscriber identification module (SIM) 496, or an antenna module 497. In some embodiments, at least one (e.g., the display device 460 or the camera module 480) of the components may be omitted from the electronic device 401, or one or more other components may be added in the electronic device 401. In some embodiments, some of the components may be implemented as single integrated circuitry. For example, the sensor module 476 (e.g., a fingerprint sensor, an iris sensor, or an illuminance sensor) may be implemented as embedded in the display device 460 (e.g., a display).

The processor 420 may execute, for example, software (e.g., a program 440) to control at least one other component (e.g., a hardware or software component) of the electronic device 401 coupled with the processor 420, and may perform various data processing or computation. According to an example embodiment, as at least part of the data processing or computation, the processor 420 may load a command or data received from another component (e.g., the sensor module 476 or the communication module 490) in volatile memory 432, process the command or the data stored in the volatile memory 432, and store resulting data in non-volatile memory 434. According to an embodiment, the processor 420 may include a main processor 421 (e.g., a central processing unit (CPU) or an application processor (AP)), and an auxiliary processor 423 (e.g., a graphics processing unit (GPU), an image signal processor (ISP), a sensor hub processor, or a communication processor (CP)) that is operable independently from, or in conjunction with, the main processor 421. Additionally or alternatively, the auxiliary processor 423 may be adapted to consume less power than the main processor 421, or to be specific to a specified function. The auxiliary processor 423 may be implemented as separate from, or as part of the main processor 421.

The auxiliary processor 423 may control at least some of functions or states related to at least one component (e.g., the display device 460, the sensor module 476, or the communication module 490) among the components of the electronic device 401, instead of the main processor 421 while the main processor 421 is in an inactive (e.g., sleep) state, or together with the main processor 421 while the main processor 421 is in an active state (e.g., executing an application). According to an embodiment, the auxiliary processor 423 (e.g., an image signal processor or a communication processor) may be implemented as part of another component (e.g., the camera module 480 or the communication module 490) functionally related to the auxiliary processor 423.

The memory 430 may store various data used by at least one component (e.g., the processor 420 or the sensor module 476) of the electronic device 401. The various data may include, for example, software (e.g., the program 440) and input data or output data for a command related thereto. The memory 430 may include the volatile memory 432 or the non-volatile memory 434.

The program 440 may be stored in the memory 430 as software, and may include, for example, an operating system (OS) 442, middleware 444, or an application 446.

The input device 450 may receive a command or data to be used by other component (e.g., the processor 420) of the electronic device 401, from the outside (e.g., a user) of the electronic device 401. The input device 450 may include, for example, a microphone, a mouse, a keyboard, or a digital pen (e.g., a stylus pen).

The sound output device 455 may output sound signals to the outside of the electronic device 401. The sound output device 455 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 460 may visually provide information to the outside (e.g., a user) of the electronic device 401. The display device 460 may include, for example, a display, a hologram device, or a projector and control circuitry to control a corresponding one of the display, hologram device, and projector. According to an embodiment, the display device 460 may include touch circuitry adapted to detect a touch, or sensor circuitry (e.g., a pressure sensor) adapted to measure the intensity of force incurred by the touch.

The audio module 470 may convert a sound into an electrical signal and vice versa. According to an embodiment, the audio module 470 may obtain the sound via the input device 450, or output the sound via the sound output device 455 or a headphone of an external electronic device (e.g., an electronic device 402) directly (e.g., wiredly) or wirelessly coupled with the electronic device 401.

The sensor module 476 may detect an operational state (e.g., power or temperature) of the electronic device 401 or an environmental state (e.g., a state of a user) external to the electronic device 401, and then generate an electrical signal or data value corresponding to the detected state. According to an embodiment, the sensor module 476 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 477 may support one or more specified protocols to be used for the electronic device 401 to be coupled with the external electronic device (e.g., the electronic device 402) directly (e.g., wiredly) or wirelessly. According to an embodiment, the interface 477 may include, for example, a high definition multimedia interface (HDMI), a universal serial bus (USB) interface, a secure digital (SD) card interface, or an audio interface.

A connecting terminal 478 may include a connector via which the electronic device 401 may be physically connected with the external electronic device (e.g., the electronic device 402). According to an embodiment, the connecting terminal 478 may include, for example, a HDMI connector, a USB connector, a SD card connector, or an audio connector (e.g., a headphone connector).

The haptic module 479 may convert an electrical signal into a mechanical stimulus (e.g., a vibration or a movement) or electrical stimulus which may be recognized by a user via his tactile sensation or kinesthetic sensation. According to an embodiment, the haptic module 479 may include, for example, a motor, a piezoelectric element, or an electric stimulator.

The camera module 480 may capture a still image or moving images. According to an embodiment, the camera module 480 may include one or more lenses, image sensors, image signal processors, or flashes.

The power management module 488 may manage power supplied to the electronic device 401. According to an example embodiment, the power management module 488 may be implemented as at least part of, for example, a power management integrated circuit (PMIC).

The battery 489 may supply power to at least one component of the electronic device 401. According to an embodiment, the battery 489 may include, for example, a primary cell which is not rechargeable, a secondary cell which is rechargeable, or a fuel cell.

The communication module 490 may support establishing a direct (e.g., wired) communication channel or a wireless communication channel between the electronic device 401 and the external electronic device (e.g., the electronic device 402, the electronic device 404, or the server 408) and performing communication via the established communication channel. The communication module 490 may include one or more communication processors that are operable independently from the processor 420 (e.g., the application processor (AP)) and supports a direct (e.g., wired) communication or a wireless communication. According to an embodiment, the communication module 490 may include a wireless communication module 492 (e.g., a cellular communication module, a short-range wireless communication module, or a global navigation satellite system (GNSS) communication module) or a wired communication module 494 (e.g., a local area network (LAN) communication module or a power line communication (PLC) module). A corresponding one of these communication modules may communicate with the external electronic device via the first network 498 (e.g., a short-range communication network, such as Bluetooth, wireless-fidelity (Wi-Fi) direct, or infrared data association (IrDA)) or the second network 499 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 492 may identify and authenticate the electronic device 401 in a communication network, such as the first network 498 or the second network 499, using subscriber information (e.g., international mobile subscriber identity (IMSI)) stored in the subscriber identification module 496.

The antenna module 497 may transmit or receive a signal or power to or from the outside (e.g., the external electronic device) of the electronic device 401. According to an embodiment, the antenna module 497 may include an antenna including a radiating element composed of a conductive material or a conductive pattern formed in or on a substrate (e.g., PCB). According to an embodiment, the antenna module 497 may include a plurality of antennas. In such a case, at least one antenna appropriate for a communication scheme used in the communication network, such as the first network 498 or the second network 499, may be selected, for example, by the communication module 490 (e.g., the wireless communication module 492) from the plurality of antennas. The signal or the power may then be transmitted or received between the communication module 490 and the external electronic device via the selected at least one antenna. According to an embodiment, another component (e.g., a radio frequency integrated circuit (RFIC)) other than the radiating element may be additionally formed as part of the antenna module 497.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 401 and the external electronic device 404 via the server 408 coupled with the second network 499. Each of the electronic devices 402 and 404 may be a device of a same type as, or a different type, from the electronic device 401. According to an embodiment, all or some of operations to be executed at the electronic device 401 may be executed at one or more of the external electronic devices 402, 404, or 408. For example, if the electronic device 401 should perform a function or a service automatically, or in response to a request from a user or another device, the electronic device 401, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 401. The electronic device 401 may provide the outcome, with or without further processing of the outcome, as at least part of a reply to the request. To that end, a cloud computing, distributed computing, or client-server computing technology may be used, for example.

Figure 5:
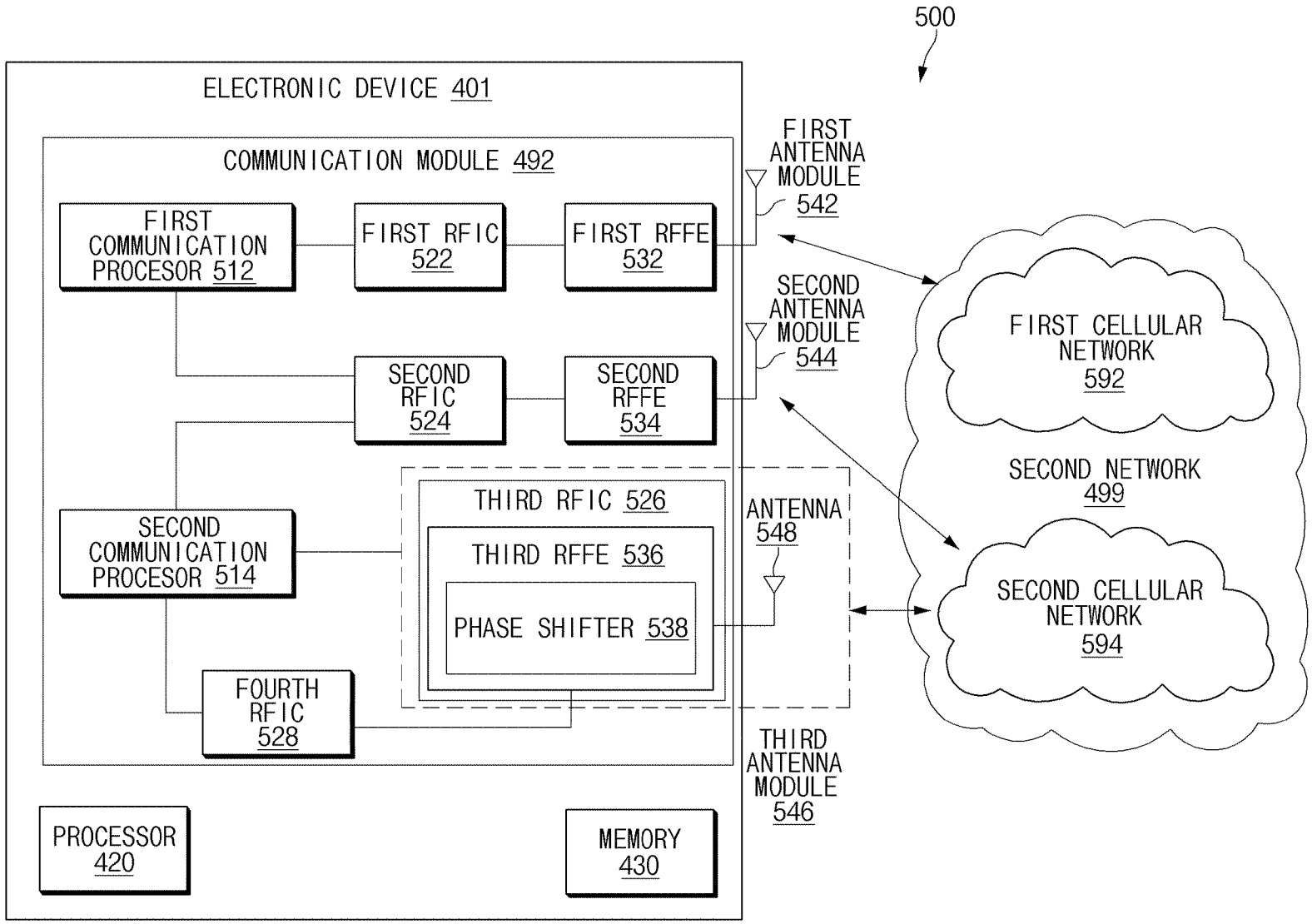
FIG. 5 is a block diagram illustrating an example electronic device for supporting legacy network communication and 5G network communication, according to various embodiments.

FIG. 5 is a block diagram 500 illustrating an example electronic device 401 for supporting legacy network communication and 5G network communication, according to various embodiments. Referring to FIG. 5, the electronic device 401 may include a first communication processor (e.g., including processing circuitry) 512, a second communication processor (e.g., including processing circuitry) 514, a first radio frequency integrated circuit (RFIC) 522, a second RFIC 524, a third RFIC 526, a fourth RFIC 528, a first radio frequency front end (REFE) 532, a second REFE 534, a first antenna module (e.g., including an antenna) 542, a second antenna module (e.g., including an antenna) 544, and an antenna 548. The electronic device 401 may further include the processor (e.g., including processing circuitry) 420 and the memory 430. A second network 499 may include a first cellular network 592 and a second cellular network 594. According to another embodiment, the electronic device 401 may further include at least one component of the components illustrated in FIG. 4, and the second network 499 may further include at least another network. According to an embodiment, the first communication processor 512, the second communication processor 514, the first RFIC 522, the second RFIC 524, the fourth RFIC 528, the first REFE 532, and the second REFE 534 may form at least a part of a wireless communication module 492. According to another embodiment, the fourth RFIC 528 may be omitted or may be included as a part of the third RFIC 526.

The first communication processor 512 may establish a communication channel for a band to be used for wireless communication with the first cellular network 592 and may support legacy network communication through the established communication channel. According to various embodiments, the first cellular network 592 may be a legacy network including a 2nd generation (2G), 3rd generation (3G), 4th generation (4G), or long term evolution (LTE) network. The second communication processor 514 may establish a communication channel for a specified band (e.g., ranging from about 6 GHz to about 60 GHz) of bands to be used for wireless communication with the second cellular network 594 and may support 5G network communication through the established communication channel. According to various embodiments, the second cellular network 594 may be a 5G network defined in the 3GPP. Additionally, according to an embodiment, the first communication processor 512 or the second communication processor 514 may establish a communication channel for any other specified band (e.g., about 6 GHz or lower) of the bands to be used for wireless communication with the second cellular network 594 and may support 5G network communication through the established communication channel. According to an embodiment, the first communication processor 512 and the second communication processor 514 may be implemented in a single chip or a single package. According to various embodiments, the first communication processor 512 or the second communication processor 514 may be implemented in a single chip or a single package together with the processor 420, the auxiliary processor (e.g., 423 of FIG. 4), or the communication module 490.

Upon transmitting a signal, the first RFIC 522 may convert a baseband signal generated by the first communication processor 512 into a radio frequency (RF) signal of about 700 MHz to about 3 GHz that is used in the first cellular network 592. Upon receiving a signal, an RF signal may be obtained from the first cellular network 592 (e.g., a legacy network) through the first antenna module 542 and may be pre-processed through an REFE (e.g., the first REFE 532). The first RFIC 522 may convert the pre-processed RF signal into a baseband signal so as to be processed by the first communication processor 512.

Upon transmitting a signal, the second RFIC 524 may convert a baseband signal generated by the first communication processor 512 or the second communication processor 514 into an RF signal (hereinafter referred to as a "5G Sub6 RF signal") in a Sub6 band (e.g., about 6 GHz or lower). Upon receiving a signal, the 5G Sub6 RF signal may be obtained from the second cellular network 594 (e.g., a 5G network) through the second antenna module 544 and may be pre-processed through an REFE (e.g., the second REFE 534). The second RFIC 524 may convert the pre-processed 5G Sub6 RF signal into a baseband signal so as to be processed by a communication processor corresponding to the 5G Sub6 RF signal from among the first communication processor 512 or the second communication processor 514.

The third RFIC 526 may convert a baseband signal generated by the second communication processor 514 into an RF signal (hereinafter referred to as a "5G Above6 RF signal") in a 5G Above6 band (e.g., ranging from about 6 GHz to about 60 GHz) to be used in the second cellular network 594 (e.g., a 5G network). Upon receiving a signal, the 5G Above6 RF signal may be obtained from the second cellular network 594 (e.g., a 5G network) through an antenna (e.g., the antenna 548) and may be pre-processed through a third REFE 536. The third RFIC 526 may convert the pre-processed 5G Above6 RF signal into a baseband signal so as to be processed by the second communication processor 514. For example, the third RFFE 536 may perform a preprocessing of the signal using a phase shifter 538. According to an embodiment, the third REFE 536 may be implemented as a part of the third RFIC 526.

According to an embodiment, the electronic device 401 may include the fourth RFIC 528 independently of the third RFIC 526 or as at least a part of the third RFIC 526. In this case, the fourth RFIC 528 may convert a baseband signal generated by the second communication processor 514 into an RF signal (intermediate frequency signal, hereinafter referred to as an "IF signal") in an intermediate frequency band (e.g., ranging from about 9 GHz to about 11 GHz) and may provide the IF signal to the third RFIC 526. The third RFIC 526 may convert the IF signal into the 5G Above6 RF signal. Upon receiving a signal, the 5G Above6 RF signal may be received from the second cellular network 594 (e.g., a 5G network) through an antenna (e.g., the antenna 548) and may be converted into an IF signal by the third RFIC 526. The fourth RFIC 528 may convert the IF signal into a baseband signal so as to be processed by the second communication processor 514.

According to an embodiment, the first RFIC 522 and the second RFIC 524 may be implemented with at least a part of a single chip or a single package. According to an embodiment, the first REFE 532 and the second REFE 534 may be implemented with at least a part of a single chip or a single package. According to an embodiment, at least one of the first antenna module 542 or the second antenna module 544 may be omitted or may be combined with any other antenna module to process RF signals in a plurality of bands.

According to an embodiment, the third RFIC 526 and the antenna 548 may be disposed at the same substrate to form a third antenna module 546. For example, the wireless communication module 492 or the processor 420 may be disposed at a first substrate (e.g., a main PCB). In this case, the third RFIC 526 may be disposed in a partial region (e.g., on a lower surface) of a second substrate (e.g., a sub PCB) independent of the first substrate, the antenna 548 may be disposed in another partial region (e.g., on an upper surface) of the second substrate, and thus, the third RFIC 526 may be implemented with the third RFIC 526 and the antenna 548. According to an embodiment, the antenna 548 may include, for example, an antenna array to be used for beamforming. As the third RFIC 526 and the antenna 548 are disposed at the same substrate, it may be possible to decrease a length of a transmission line between the third RFIC 526 and the antenna 548. This may make it possible to reduce the loss (e.g., attenuation) due to the transmission line, with regard to a signal in a high-frequency band (e.g., ranging from about 6 GHz to about 60 GHz) that is used for the 5G network communication. As such, the electronic device 401 may improve the quality or speed of communication with the second cellular network 594 (e.g., a 5G network).

The second cellular network 594 (e.g., a 5G network) may be used independently of the first cellular network 592 (e.g., a legacy network) (e.g., stand-alone (SA)) or may be used in conjunction with the first cellular network 592 (e.g., non-stand alone (NSA)). For example, only an access network (e.g., a 5G radio access network (RAN) or a next generation RAN (NG RAN)) may be present in the 5G network, and a core network (e.g., a next generation core (NGC)) may be absent from the 5G network. In this case, the electronic device 401 may access the access network of the 5G network and may then access an external network (e.g., Internet) under control of the core network (e.g., an evolved packed core (EPC)) of the legacy network. Protocol information (e.g., LIE protocol information) for communication with the legacy network or protocol information (e.g., New Radio (NR) protocol information) for communication with the 5G network may be stored in the memory 530 so as to be accessed by any other component (e.g., the processor 520, the first communication processor 512, or the second communication processor 514).

Figure 6A:
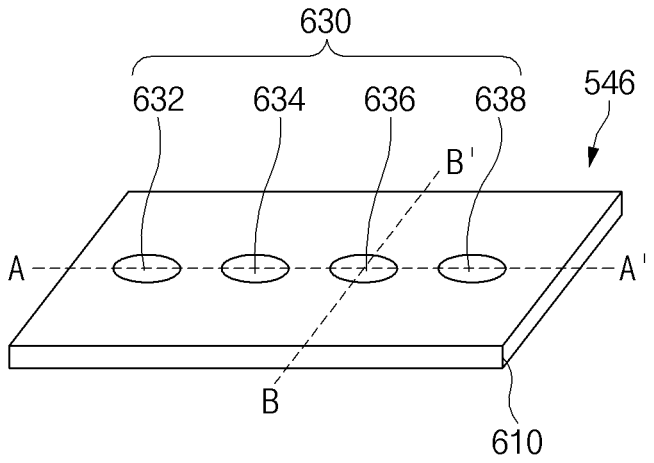
FIGS. 6A, 6B and 6C are diagrams illustrating an example structure of a third antenna module described with reference to FIG. 5 according to an embodiment.
Figure 6B:
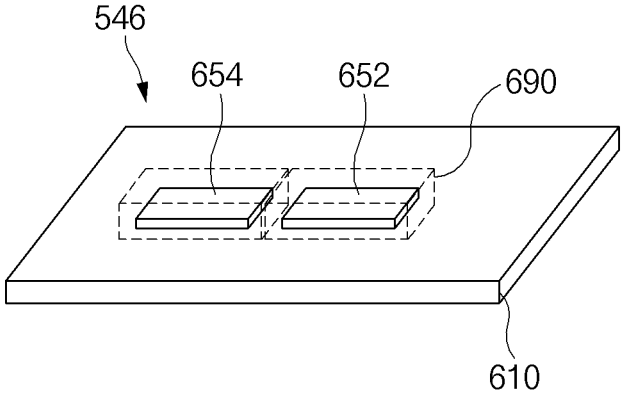
Figure 6C:
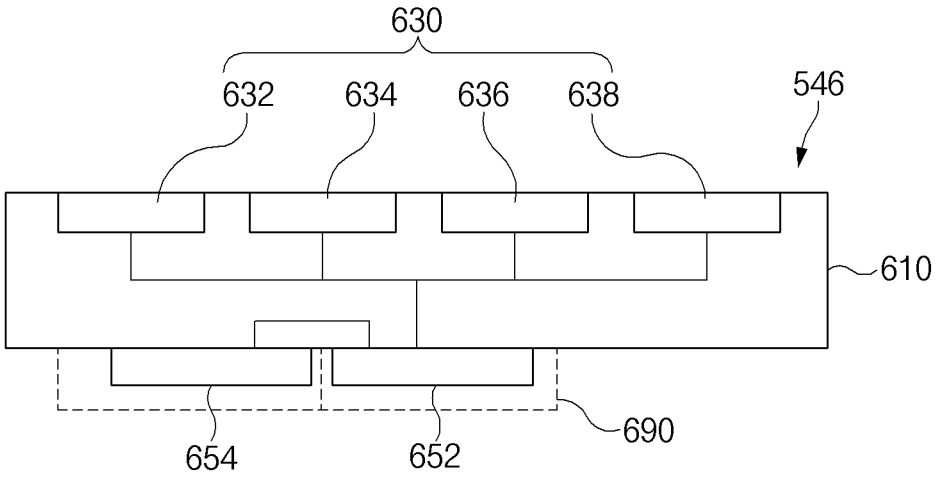

FIGS. 6A, 6B and 6C are diagrams illustrating an example structure of the third antenna module 546 of FIG. 5 according to various embodiments. FIG. 6A is a perspective view of the third antenna module 546 viewed from one side. FIG. 6B is a perspective view of the third antenna module 546 viewed from the other side. FIG. 6C is a cross-sectional view of the third antenna module 546 taken along line A-A'.

Referring to FIGS. 6A, 6B and 6C, in an embodiment, the third antenna module 546 may include a printed circuit board 610, an antenna array 630, an RFIC 652, a power manage integrated circuit (PMIC) 654, and a module interface. Selectively, the third antenna module 546 may further include a shielding member (e.g., a shield can) 690. In various embodiments, at least one of the above components may be omitted, or at least two of the components may be integrally formed.

The printed circuit board 610 may include a plurality of conductive layers and a plurality of non-conductive layers, and the conductive layers and the non-conductive layers may be alternately stacked. The printed circuit board 610 may provide electrical connection with various electronic components, which are disposed on the printed circuit board 610 or on the outside, by using wires and conductive vias formed in the conductive layers.

The antenna array 630 (e.g., 548 of FIG. 5) may include a plurality of antenna elements 632, 634, 636, and 638 disposed to form a directional beam. The antenna elements 632, 634, 636, and 638 may be formed on a first surface of the printed circuit board 610 as illustrated. According to various embodiments, the antenna array 630 may be formed in the printed circuit board 610. According to embodiments, the antenna array 630 may include a plurality of antenna arrays (e.g., a dipole antenna array and/or a patch antenna array), the shapes or kinds of which are identical or different.

The RFIC 652 (e.g., third RFIC 526 of FIG. 5) may be disposed on another region (e.g., a second surface opposite to the first surface) of the printed circuit board 610 so as to be spaced from the antenna array 630. The RFIC 652 may be configured to process a signal in a selected frequency band, which is transmitted/received through the antenna array 630. According to an embodiment, upon transmitting a signal, the RFIC 652 may convert a baseband signal obtained from a communication processor (not illustrated) into an RF signal. Upon receiving a signal, the RFIC 652 may convert an RF signal received through the antenna array 630 into a baseband signal and may provide the baseband signal to the communication processor.

According to another embodiment, upon transmitting a signal, the RFIC 652 may up-convert an IF signal (e.g., about 9 GHz to about 11 GHz) obtained from an intermediate frequency integrated circuit (IFIC) (e.g., fourth RFIC 528 of FIG. 5) into an RF signal. Upon receiving a signal, the RFIC 652 may down-convert an RF signal obtained through the antenna array 630 into an IF signal and may provide the IF signal to the IFIC.

The PMIC 654 may be disposed on another region (e.g., the second surface) of the printed circuit board 610 so as to be spaced from the antenna array 630. The PMIC 654 may be supplied with a voltage from a main PCB (not illustrated) and may provide a power necessary for various components (e.g., the RFIC 652) on an antenna module.

The shielding member 690 may be disposed on a portion (e.g., on the second surface) of the printed circuit board 610 such that at least one of the RFIC 652 or the PMIC 654 is electromagnetically shielded. According to an embodiment, the shielding member 690 may include a shield can.

Although not illustrated, in various embodiments, the third antenna module 546 may be electrically connected with another printed circuit board (e.g., a main circuit board) through a module interface. The module interface may include a connection member, for example, a coaxial cable connector, a board to board connector, an interposer, or a flexible printed circuit board (FPCB). The RFIC 652 and/or the PMIC 654 of the third antenna module 546 may be electrically connected with the printed circuit board 610 through the connection member.

Figure 7:
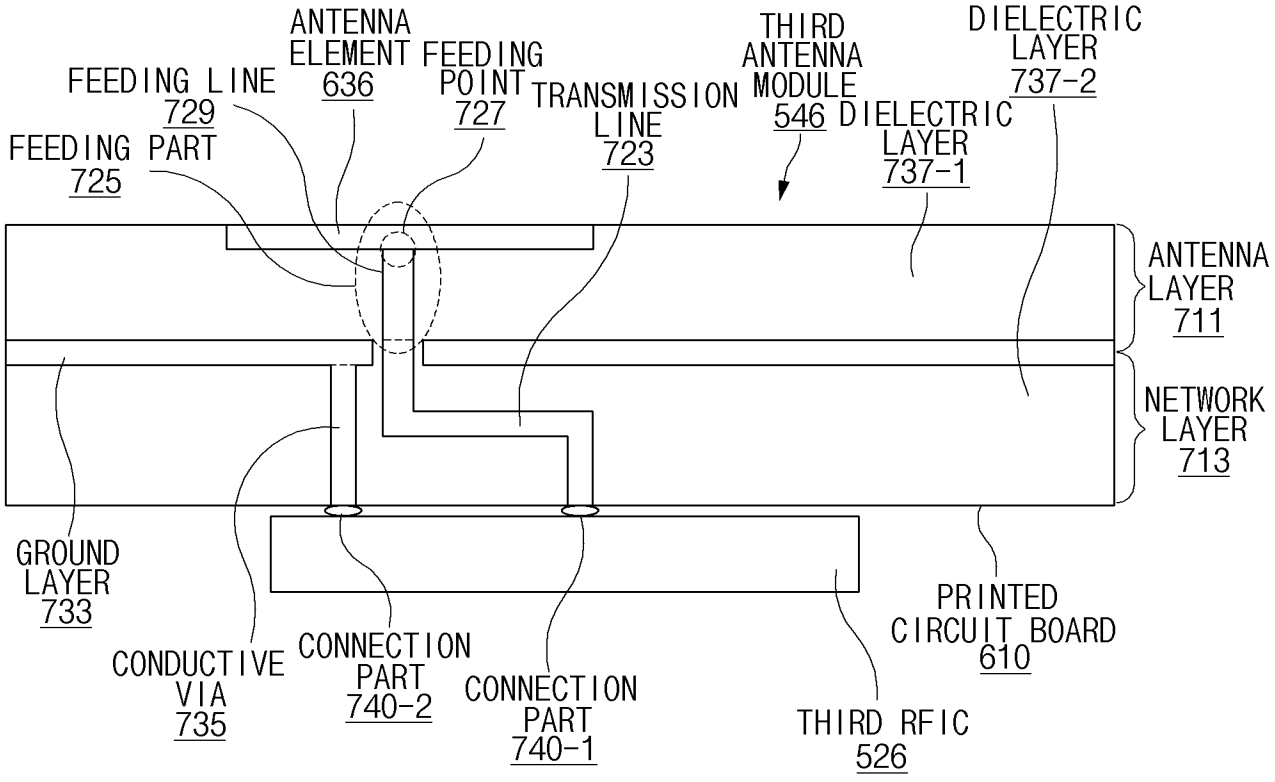
FIG. 7 is a cross-sectional view illustrating an example third antenna module taken along a line A-A' of FIG. 6A according to an embodiment.

FIG. 7 is a cross section of line B-B' of a third antenna module 546 shown in FIG. 6A. The printed circuit board 610 of an embodiment illustrated may include an antenna layer 711 and a network layer 713.

The antenna layer 711 may include at least one dielectric layer 737-1, and an antenna element 636 and/or a feeding part 725 formed on an outer surface of the dielectric layer 737-1 or therein. The feeding part 725 may include a feeding point 727 and/or a feeding line 729.

The network layer 713 may include at least one dielectric layer 737-2; and at least one ground layer 733, at least one conductive via 735, a transmission line 723, and/or the feeding line 729, which are formed on an outer surface of the dielectric layer 737-2 or therein.

In addition, in the embodiment illustrated, the third RFIC 526 of FIG. 5 may be electrically connected with the network layer 713, for example, through first and second connection parts (e.g., solder bumps) 740-1 and 740-2. In various embodiments, various connection structures (e.g., soldering or a ball grid array (BGA)). The third RFIC 526 may be electrically connected with the antenna element 636 through the first connection part 740-1, the transmission line 723, and the feeding part 725. Also, the third RFIC 526 may be electrically connected with the ground layer 733 through the second connection part 740-2 and the conductive via 735. Although not illustrated, the third RFIC 526 may also be electrically connected with the above module interface through the feeding line 729.

Figure 8:
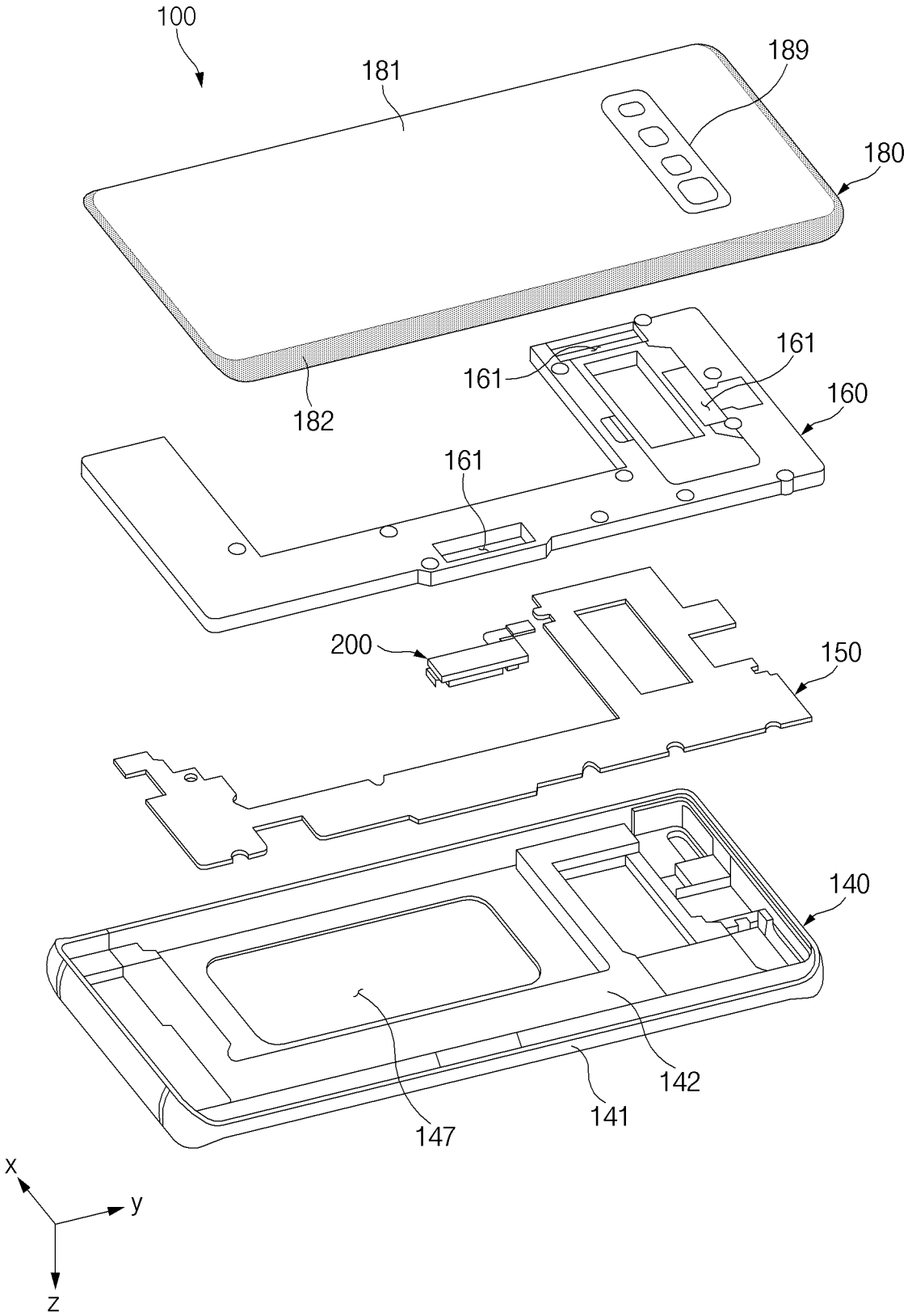
FIG. 8 is an exploded perspective view illustrating an example electronic device according to an embodiment.

FIG. 8 is an exploded perspective view illustrating an example electronic device according to an embodiment.

In an embodiment, the electronic device 100 may include the second plate 180 forming a second surface of the electronic device 100, the side member (e.g., a side housing) 140 including a first structure 141 connected with an edge portion 182 of the second plate 180 and a second structure 142 (e.g., the first support member 142 of FIG. 3) extended from the first structure 141 to the interior of the electronic device 100, the printed circuit board (or substrate) 150 interposed between the second structure 142 of the side member 140 and the second plate 180, and a mid plate 160 interposed between the printed circuit board 150 and the second plate 180.

Referring to FIG. 8, the second plate 180 may include a central portion 181 and the edge (or outer) portion 182 surrounding the central portion 181. A camera region 189 that is transparently formed such that a camera included in the electronic device 100 is viewable through a second surface of the electronic device 100 may be formed at the central portion 181 of the second plate 180. The edge portion 182 of the second plate 180 may be bent toward the side member 140 with a given curvature.

In various embodiments, the central portion 181 of the second plate 180 may be formed in the shape of a flat surface. In an embodiment, the central portion 181 of the second plate 180 may be formed in the shape of a curved surface.

In various embodiments, a space where the printed circuit board 150 and the mid plate 160 are disposed may be formed between the second plate 180 and the first structure 141 of the side member 140. The space may be formed by connecting the edge portion 182 of the second plate 180 and the first structure 141 of the second plate 180.

In an embodiment, the first structure 141 of the side member 140 may surround the mid plate 160 and the printed circuit board 150, and the second structure 142 of the side member 140 may be coupled to the mid plate 160 and the printed circuit board 150. A swelling hole 147 may be formed at the second structure 142 in consideration of the case where a battery swells when charged. The swelling hole 147 may be formed at a region that corresponds to at least a portion of the battery. The first structure 141 of the side member 140 may be formed in the shape of a curved surface corresponding to a curved surface of the edge portion 182 of the second plate 180.

The mid plate 160 may be interposed between the second plate 180 and the printed circuit board 150. The mid plate 160 may include at least one opening 161 where an antenna module 200 is able to be disposed. In this case, the opening 161 may be formed to penetrate the mid plate 160.

Figure 9A:
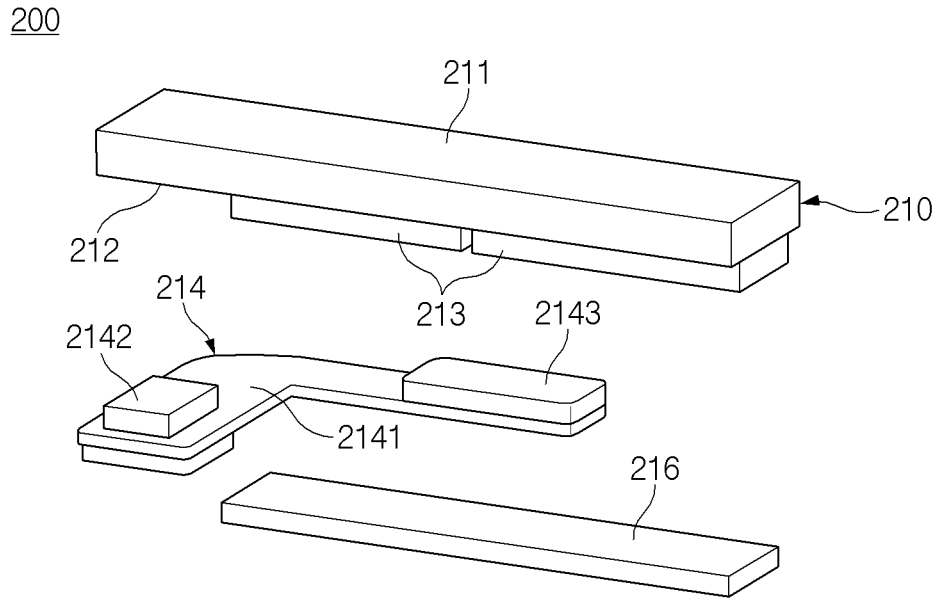
FIGS. 9A, 9B and 9C are diagrams illustrating an example antenna module of an electronic device according to an embodiment.
Figure 9B:
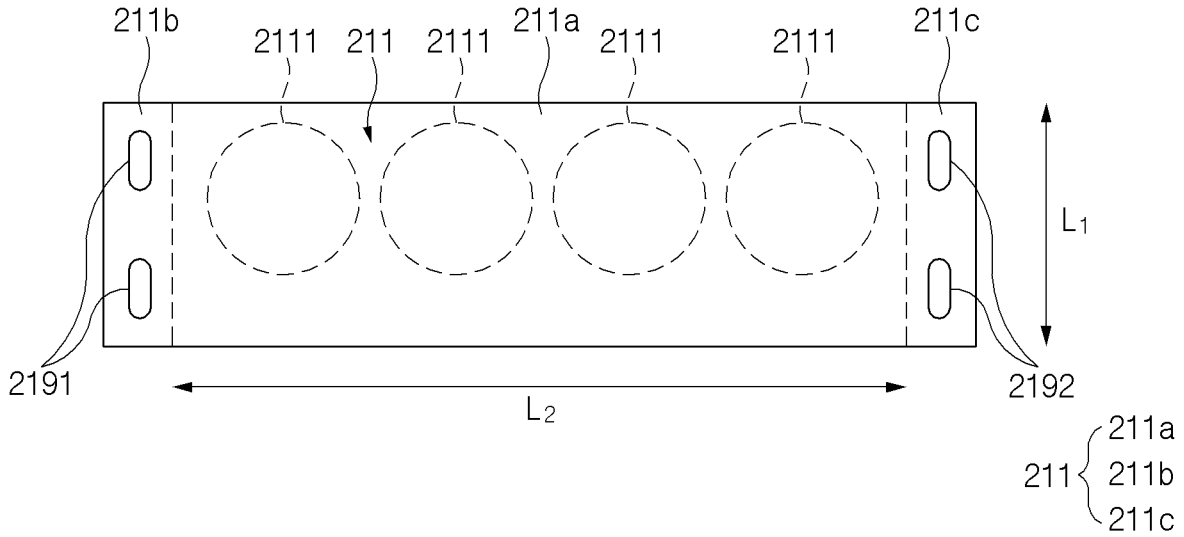
Figure 9C:
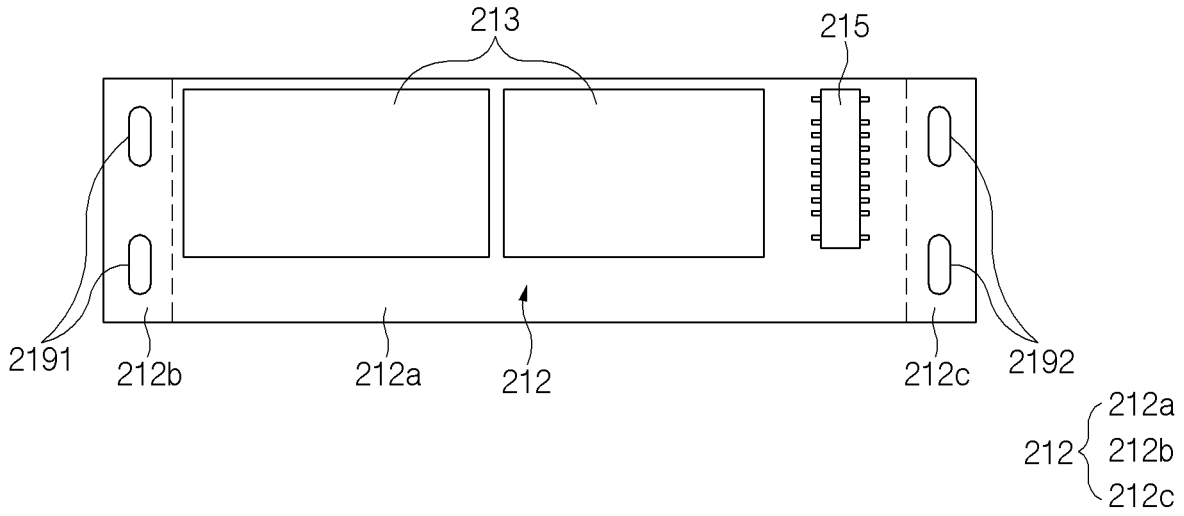

FIGS. 9A, 9B and 9C are diagrams illustrating the antenna module 200 of an electronic device according to an embodiment.

Referring to FIG. 9A, the antenna module 200 may include an antenna substrate 210 including a conductive pattern, a wireless communication circuit 213, a heat radiation member 216, and a connection member 214.

The antenna substrate 210 may include a first surface 211 where a first radiation region 2111 for radiating a first RF signal is formed, a second surface 212 facing away from the first surface 211, and a conductive pattern forming the first radiation region 2111. The conductive pattern may be formed on a surface of the antenna substrate 210 or may be formed in the antenna substrate 210.

Referring to FIG. 9B, the first surface 211 may include a first region 211*a* including a plurality of first radiation regions 2111, and a second region 211*b* and a third region 211*c* formed on opposite sides of the first region 211*a*.

In the embodiment that is illustrated, the plurality of first radiation regions 2111 may be arranged on the first surface 211 of the antenna substrate 210 in one direction. In this case, the second region 211*b* and the third region 211*c* may be formed on opposite sides of the first region 211*a* with respect to a direction in which the first radiation regions 2111 are arranged.

Referring to FIG. 9C, one or more holes 2191 and 2192 may be formed at at least a portion of the second surface 212 of the antenna substrate 210. The second surface 212 of the antenna substrate 210 may include a first correspondence region 212*a* corresponding to the first region 211*a* of the first surface 211, a second correspondence region 212*b* that corresponds to the second region 211*b* and in which the one or more holes 2191 are formed, and a third correspondence region 212*c* that corresponds to the third region 211*c* and in which the one or more holes 2192 are formed.

The second correspondence region 212*b* and the third correspondence region 212*c* may be formed around the first correspondence region 212*a*. In the embodiment that is illustrated, the second correspondence region 212*b* and the third correspondence region 212*c* may be formed on opposite sides of the first correspondence region 212*a* in one direction. The first hole 2191 may be formed at the second correspondence region 212*b*, and the second hole 2192 may be formed at the third correspondence region 212*c*. In an embodiment, the first hole 2191 may be extended from the second correspondence region 212*b* of the second surface 212 to the second region 211*b* of the first surface 211 so as to penetrate the antenna substrate 210. The second hole 2192 may be extended from the third correspondence region 212*c* of the second surface 212 to the third region 211*c* of the first surface 211 so as to penetrate the antenna substrate 210.

The wireless communication circuit 213 may be disposed on the second surface 212 of the antenna substrate 210. At least a portion of the wireless communication circuit 213 may be disposed at the first correspondence region 212*a* of the second surface 212. The wireless communication circuit 213 may be electrically connected with a conductive pattern that is formed on the surface (e.g., the first surface 211) of the antenna substrate 210 or is included in the antenna substrate 210. The wireless communication circuit 213 may feed a power to the conductive pattern such that the first RF signal is radiated through the first radiation region 2111.

The heat radiation member 216 may be disposed at the wireless communication circuit 213 for the purpose of removing the heat generated from the wireless communication circuit 213. The heat radiation member 216 may be disposed on the second surface 212 of the antenna substrate 210 so as to cover the wireless communication circuit 213.

The connection member 214 may include a FPCB 2141 for electrically connecting the wireless communication circuit 213 and a printed circuit board of an electronic device and one or more connectors 2142 and 2143 formed on the FPCB 2141. The one or more connectors 2142 and 2143 may include the first connector 2142 coupled to a correspondence connector formed on the second surface 212 of the antenna substrate 210 and the second connector 2143 coupled to the printed circuit board (e.g., the printed circuit board 150 of FIG. 8) of the electronic device 100.

Figure 10:
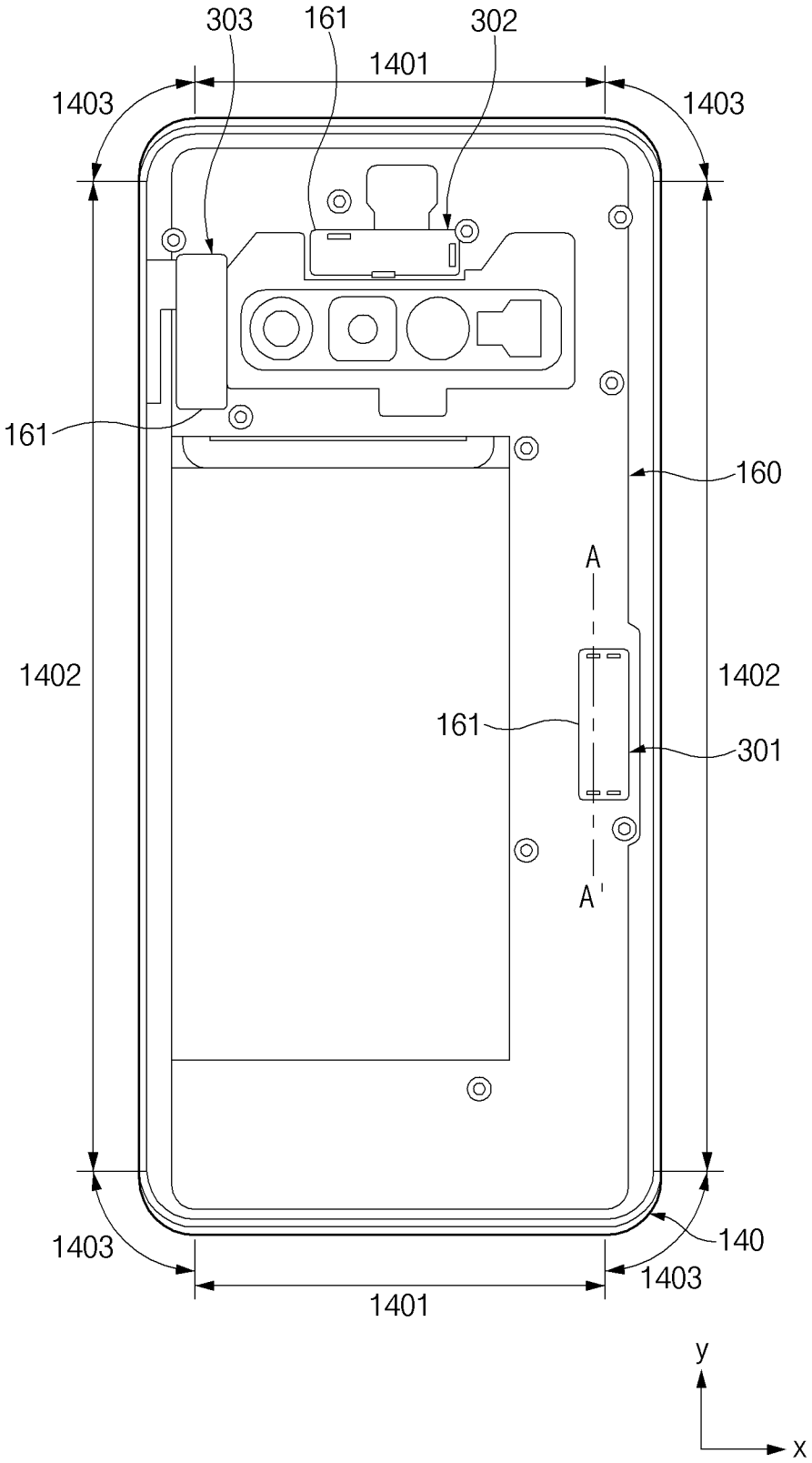
FIG. 10 is a diagram illustrating an example electronic device viewed from above a second surface (e.g., a surface facing a negative direction of a z-axis of FIG. 8) of the electronic device where a second plate is omitted, according to an embodiment.

FIG. 10 is a diagram illustrating an example electronic device viewed from above a second surface (e.g., a surface facing a negative direction of a z-axis of FIG. 8) of the electronic device where a second plate is omitted, according to an embodiment.

Referring to FIG. 10, an electronic device may include the mid plate 160 where one or more openings 161 are formed, the side member (e.g., side housing) 140 surrounding a peripheral (or outer) portion of the mid plate 160, and antenna modules 301, 302, and 303 disposed in the openings 161.

The side member 140 may include a first portions 1401 formed with a first length, a second portion 1402 formed with a second length longer than the first length, and a third portion 1403 formed between the first portion 1401 and the second portion 1402 such that the first portion 1401 and the second portion 1402 are connected. The first portion 1401 may be extended in the first direction, and the second portion 1402 may be extended in a direction perpendicular to the first direction.

The antenna modules 301, 302, and 303 may include the second antenna module 302 disposed adjacent to the first portion 1401, the first antenna module 301 disposed at the second portions 1402, and the third antenna module 303 disposed at the second portions 1402.

The first antenna module 301 may be disposed adjacent to the second portion 1402 such that a longitudinal direction (e.g., an arrangement direction of the first radiation regions 2111 of FIG. 9 or a direction of a long side L2 of the antenna module 200 of FIG. 9) is substantially parallel to the second direction. The second antenna module 302 may be disposed adjacent to the first portion 1401 such that a longitudinal direction (e.g., an arrangement direction of the first radiation regions 2111 of FIG. 9 or a direction of the long side L2 of the antenna module 200 of FIG. 9) is substantially parallel to the first direction. The third antenna module 303 may be disposed adjacent to the second portion 1402 such that a longitudinal direction (e.g., an arrangement direction of the first radiation regions 2111 of FIG. 9 or a direction of a long side L2 of the antenna module 200 of FIG. 9) is substantially parallel to the second direction.

In an embodiment, the first antenna module 301 and the third antenna 303 module are disposed in different side with respect to the center line formed at the same distance from the pair of second portions 1402 facing each other. The center line extends in the second direction. For example, the first antenna module 301 is disposed on the right side of the center line, and the third antenna module 303 is disposed on the left side of the center line.

Figure 11:
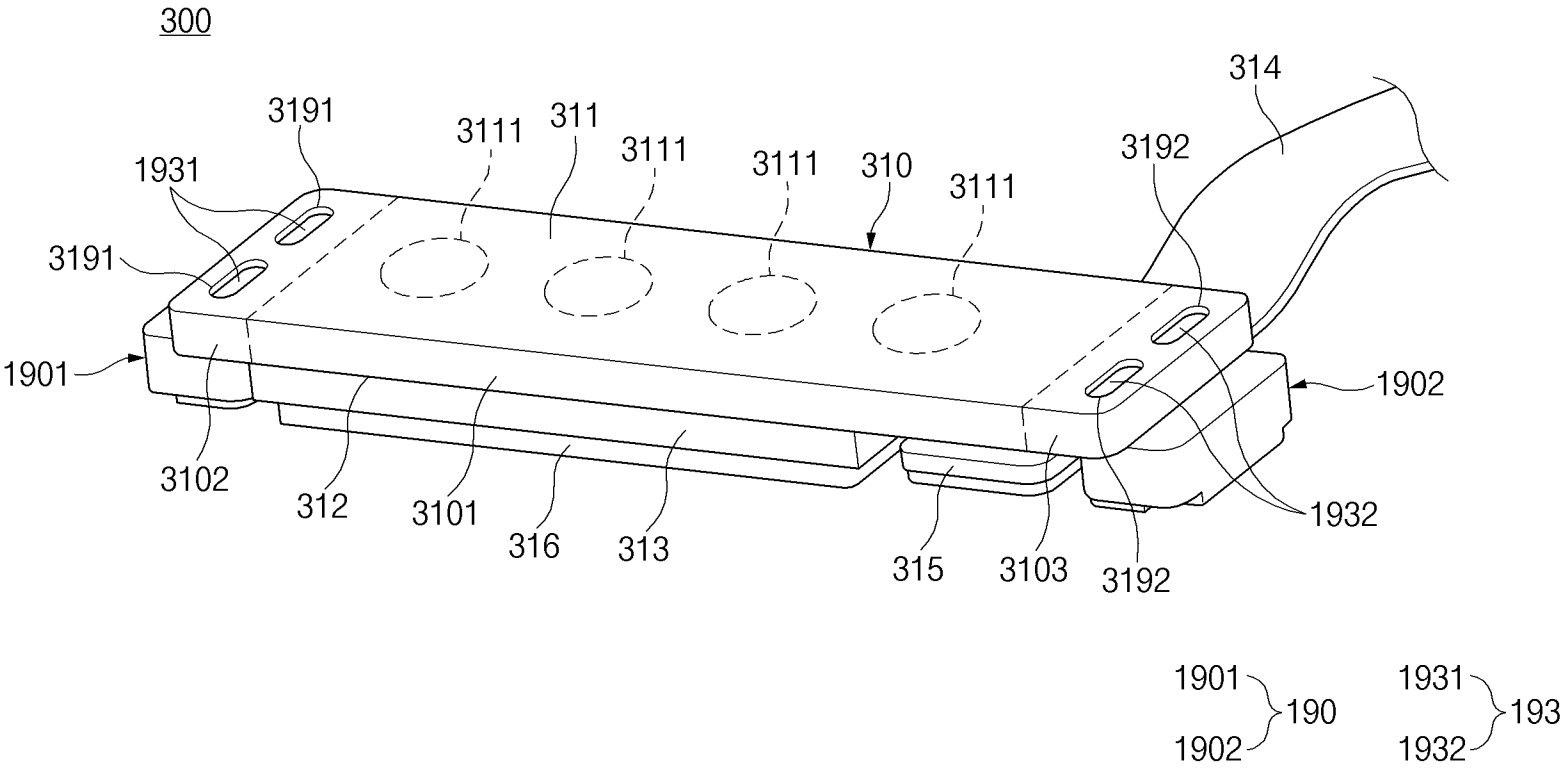
FIG. 11 is a diagram illustrating an example antenna module of an electronic device according to an embodiment.
Figure 12:
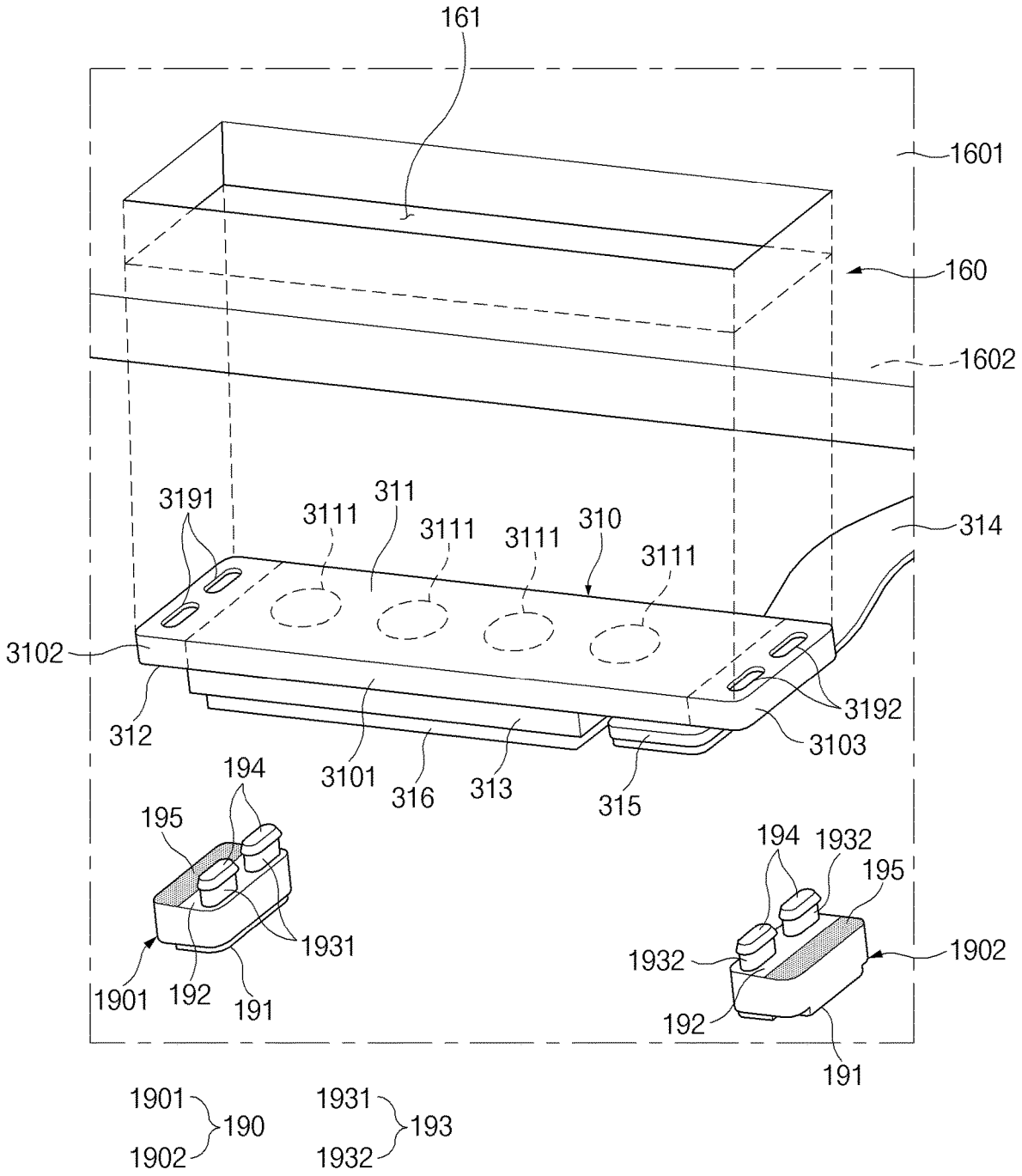
FIG. 12 is a diagram illustrating how an example antenna module and a mid plate of an electronic device are coupled, according to an embodiment.

FIG. 11 is a diagram illustrating an example antenna module 300 of an electronic device according to an embodiment. FIG. 12 is a diagram illustrating how the example antenna module 300 and the mid plate 160 of an electronic device are coupled, according to an embodiment.

In an embodiment, an electronic device may include the antenna module 300 and a coupling member coupled to the antenna module 300.

Referring to FIG. 11, the antenna module 300 may include an antenna substrate 310, coupling members (e.g., support coupler) 190 coupled to opposite ends of the antenna substrate 310, a wireless communication circuit 313 and a heat radiation member 316 interposed between the coupling members 190 and disposed on a second surface 312 of the antenna substrate 310, and a connection member 314 electrically connected with the wireless communication circuit 313.

In the embodiment that is illustrated, the antenna substrate 310 may include a first portion 3101 including a conductive pattern, a second portion 3102 formed on one side of the first portion 3101 and including one or more holes 3191 formed therein, and a third portion 3103 formed on an opposite side of the first portion 3101 and including one or more holes 3192 formed therein. The conductive pattern may form a first radiation region 3111 on a first surface 311 of the antenna substrate 310 and may be implemented on a surface of the first portion 3101 or in the interior of the first portion 3101.

The first portion 3101 of the antenna substrate 310 may include the first surface 311 on which there is formed the first radiation region 3111 where an RF signal is radiated, and the second surface 312 on which the wireless communication circuit 313 is disposed. In this case, the RF signal may be radiated through the first radiation region 3111 as the conductive pattern is fed with a power. A hole may be formed to penetrate the second portion 3102.

In an embodiment, the antenna module 300 may include the antenna substrate 310 including the first surface 311 and the second surface 312 facing away from the first surface 311, a first peripheral portion (e.g., the second portion 3102) including the first holes 3191 formed on the second surface 312, a second peripheral portion (e.g., the third portion 3103) including the second holes 3192 formed on the second surface 312, and the wireless communication circuit 313 disposed on the second surface 312 of the antenna substrate 310. In this case, the antenna substrate 310 may include a conductive pattern, and the conductive pattern may be formed on or in the antenna substrate 310. The first peripheral portion (e.g., the second portion 3102) and the second peripheral portion (e.g., the third portion 3103) may be disposed on opposite sides of the antenna substrate 310. The first peripheral portion (e.g., the second portion 3102) and the second peripheral portion (e.g., the third portion 3103) may be formed on opposite sides of the antenna substrate 310, which are defined along a long-side direction (e.g., direction L2 of FIG. 9) of the antenna substrate 310.

In the embodiment that is illustrated, the coupling member 190 may include a first coupling member 1901 inserted into and coupled to the first holes 3191 of the antenna substrate 310 and a second coupling member 1902 inserted into and coupled to the second hole 2192. Each of the first coupling member 1901 and the second coupling member 1902 may support at least a portion of each of the second portion 3102 and the third portion 3103 of the antenna substrate 310.

In the embodiment that is illustrated, the first coupling member 1901 may include first protrusions 1931 that are extended to the interior of the first holes 3191. The second coupling member 1902 may include second protrusions 1932 that are extended to the interior of the second holes 3192. The first coupling member 1901 and the antenna substrate 310 may be coupled as the first protrusions 1931 of the first coupling member 1901 are inserted into the first holes 3191. The second coupling member 1902 and the antenna substrate 310 may be coupled as the second protrusion 1932*s* of the second coupling member 1902 are inserted into the second holes 3192.

In the embodiment illustrated in FIG. 12, the electronic device 100 may further include the mid plate 160 where the opening 161 is formed.

The antenna module 300 may include the antenna substrate 310 disposed in the opening 161 formed at the mid plate 160, a conductive pattern included in the antenna substrate 310, the wireless communication circuit 313 disposed on the second surface 312 of the antenna substrate 310, the heat radiation member 316 disposed on the wireless communication circuit 313, and the connection member 314 connected with the wireless communication circuit 313. The wireless communication circuit 313 may be electrically connected with the conductive pattern, and may feed a power to the conductive pattern such that an RF signal is radiated.

Referring to FIG. 12, the coupling member 190 may include a second support surface 192 disposed on a second surface 1602 of the mid plate 160, a first support surface 191 facing away from the second support surface 192 and disposed on a printed circuit board (e.g., the printed circuit board 150 of FIG. 8), a protrusion 193 (e.g., the first protrusion 1931 and the second protrusion 1932) formed on the second support surface 192 and extended to the interior of holes (e.g., the first holes 3191 and the second holes 3192) formed at the second portion 3102 and the third portion 3103 of the antenna substrate 310, and a press-fitting portion 194 formed at the protrusion 193.

A partial region of the second support surface 192 included in the first coupling member 1901 may support the second portion 3102 of the antenna substrate 310, and the remaining region thereof may support the second surface 1602 (e.g., a region surrounding the opening 161) of the mid plate 160. A partial region of the second support surface 192 included in the second coupling member 1902 may support the third portion 3103 of the antenna substrate 310, and the remaining region thereof may support the second surface 1602 (e.g., a region surrounding the opening 161) of the mid plate 160.

An adhesive member 195 may be disposed at the region of the second support surface 192, which supports the second surface 1602 of the mid plate 160. The adhesive member 195 may include a double-sided adhesive tape.

Figure 13A:
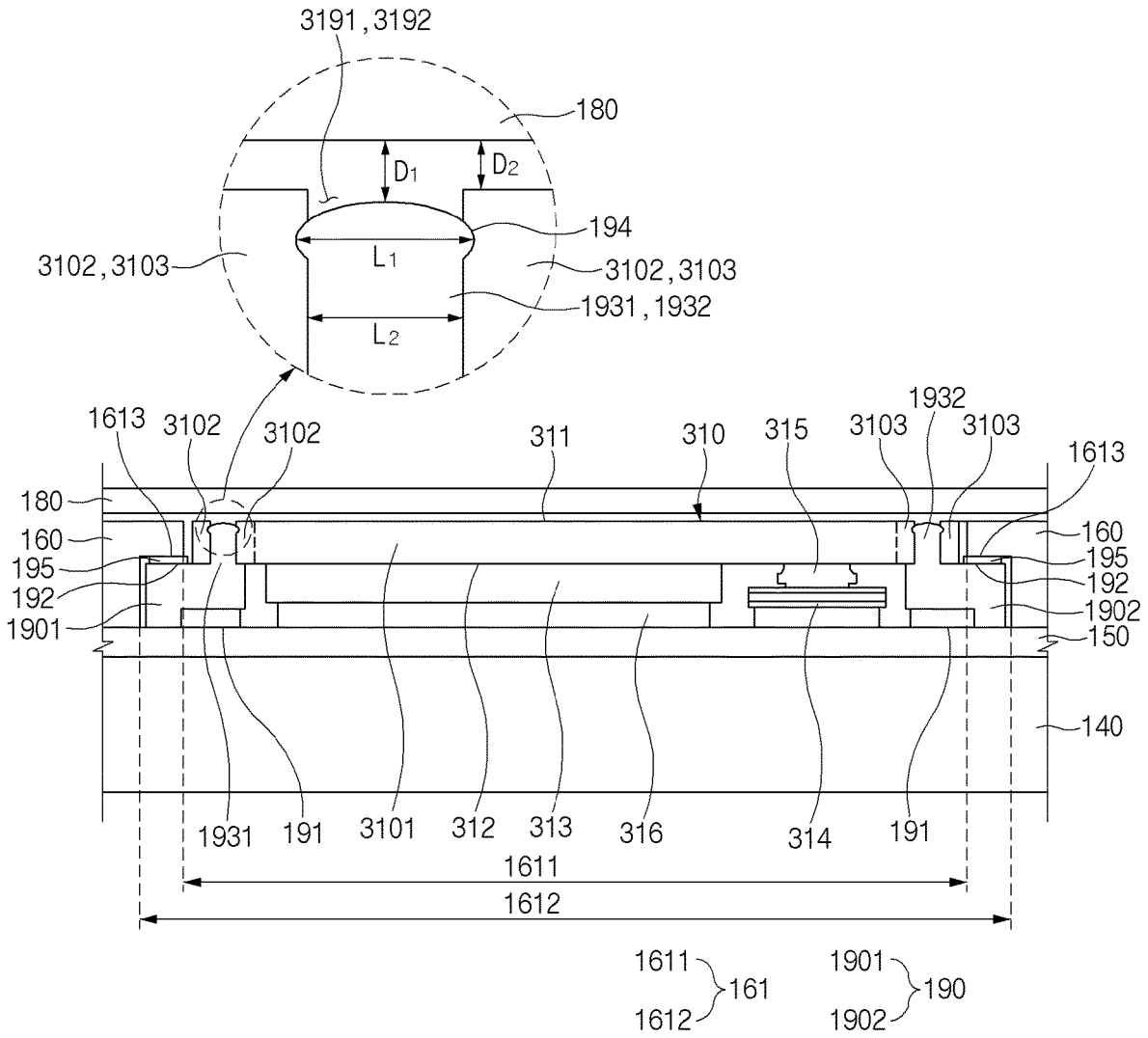
FIGS. 13A and 13B are sectional views illustrating how an example antenna module of an electronic device is disposed, according to an embodiment.
Figure 13B:
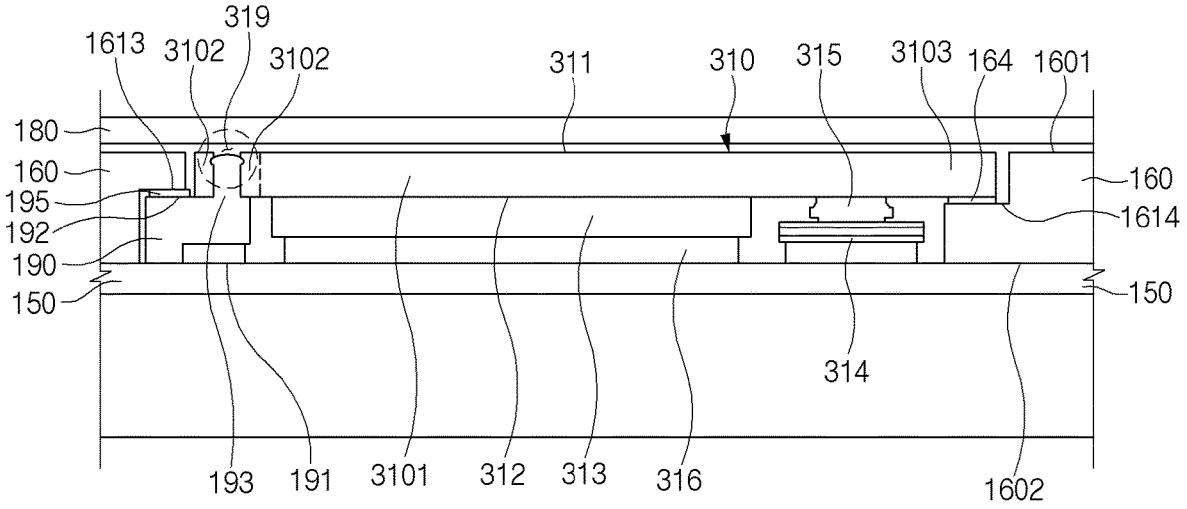

FIGS. 13A and 13B are diagrams illustrating how the example antenna module 300 of an electronic device is disposed, according to an embodiment. FIGS. 13A and 13B are cross sections taken along a line A-A' of FIG. 10.

Referring to FIGS. 13A and 13B, an electronic device may include the second plate 180 forming the second surface 312 (e.g., a back surface) of the electronic device, the side member 140 forming a third surface (e.g., a side surface) of the electronic device and including the second structure 142 facing the second plate 180, the printed circuit board 150 interposed between the second plate 180 and the second structure 142, the mid plate 160 where at least one opening 161 are formed, and the antenna module 300, of which at least a portion is disposed in the opening 161. The printed circuit board 150 may be disposed on a surface of the side member 140, which substantially faces the second plate 180.

The antenna module 300 may include the antenna substrate 310 including the first portion 3101, and the second portion 3102 and the third portion 3103 formed around the first portion 3101 and where the holes 3191 and 3192 are formed, the wireless communication circuit 313 disposed on the antenna substrate 310, the heat radiation member 316 disposed on the wireless communication circuit 313, and the connection member 314 connected with the wireless communication circuit 313.

The antenna substrate 310 may be disposed in an opening formed at the mid plate 160. The antenna substrate 310 may include the first surface 311 facing the second plate 180 and the second surface 312 facing away from the first surface 311. The wireless communication circuit 313 may be disposed on the second surface 312, and a correspondence connector 315 that is connected with the connection member 314 may be formed.

In the embodiment that is illustrated, the antenna module 300 may be disposed on the printed circuit board 150. The antenna substrate 310 may be disposed to be spaced from the first surface 311 of the printed circuit board 150 as much as a given distance.

The mid plate 160 may include the opening 161 where the antenna module 300 is disposed. The opening 161 may include a first portion 1611 and a second portion 1612. The first portion 1611 may be formed to be smaller than the second portion 1612. A portion of the antenna substrate 310 and a portion of the coupling member 190 may be disposed at the first portion 1611, and a portion of the coupling member 190, the wireless communication circuit 313, the heat radiation member 316, and a portion of the connection member 314 may be disposed at the second portion 1612. The first portion 3101 and the second portion 3102 may be connected to be stepped and may form a stepped surface 1613.

At least a portion of the coupling member 190 may be maintained between a surrounding region of the opening 161 formed at the mid plate 160 and a first surface of the printed circuit board 150 such that the coupling member 190 is prevented from moving toward the second plate 180. The coupling member 190 may include the first support surface 191 disposed on the first surface 1501 of the printed circuit board 150, the second support surface 192 facing the second plate 180, and the protrusion 1931, 1932 formed on the second support surface 192 and protruding in a direction facing the second plate 180.

Referring to FIG. 13A, the protrusion 1931 included in the first coupling member 1901 may be inserted into the hole 3191 formed at the second portion 3102 of the antenna substrate 310. The protrusion 1932 included in the second coupling member 1902 may be inserted into the hole 3192 formed at the third portion 3103 of the antenna substrate 310.

The second support surface 192 may be in contact with the stepped surface 1613 of the opening 161. The second support surface 192 may further include the adhesive member 195 formed at a region being in contact with the stepped surface 1613. As the stepped surface 1613 of the opening 161 and the second support surface 192 of the coupling member 190 are disposed to face each other, the coupling member 190 may be prevented from moving toward the second plate 180.

Referring to an enlarged view illustrated in FIG. 13A, the protrusion 1931, 1932 of the coupling member 190 may further include the press-fitting portion 194 of the coupling member 190. The press-fitting portion 194 may press an inner surface of the hole 3191 or 3192 formed at the second portion 3102 or the third portion 3103. The protrusion 1931, 1932 of the coupling member 190 may be extended from the second support surface 192 in a direction facing the second plate 180, and the press-fitting portion 194 may be formed from the protrusion 1931, 1932 in a direction substantially perpendicular to the extending direction of the protrusion 1931, 1932. In an embodiment, the press-fitting portion 194 may protrude from the center of the protrusion 193 in a radius direction.

In the embodiment that is illustrated, referring to the enlarged view, the protrusion 1931, 1932 may be formed with substantially the same size L2 as the holes 3191 and 3192 formed at the second portion 3102 and the third portion 3103, and the press-fitting portion 194 may be formed to be substantially larger than the holes 3191 and 3192 (L1).

In various embodiments, in the case where the protrusion 1931, 1932 is inserted, a partial region of an inner surface of each of the holes 3191 and 3192 may be caved by the press-fitting portion 194. As such, the coupling member 190 may be press-fitted with the antenna substrate 310.

Referring to the embodiment illustrated in FIG. 13B, the antenna substrate 310 may include the first portion 3101, the second portion 3102 formed on one side of the first portion 3101, and the third portion 3103 formed on an opposite side of the first portion 3101, and the hole 319 may be formed at the first portion 3101 such that the protrusion 193 of the coupling member 190 is extended to the interior of the hole 310. In various embodiments, the protrusion 193 may be press-fitted with an inner side surface of the hole 319.

Meanwhile, because a hole is not formed at the third portion 3103, the third portion 3103 may be supported by a support surface 1614 formed at the mid plate 160. The mid plate 160 may include the stepped surface 1613 formed at the region thereof, which corresponds to the second portion 3102 of the antenna substrate 310, and the support surface 1614 formed at the region thereof, which corresponds to the third portion 3103 of the antenna substrate 310. The support surface 1614 of the mid plate 160 may be between a first surface 1601 of the mid plate 160 facing the second plate 180 and the second surface 1602 of the mid plate 160 disposed on the printed circuit board 150. The support surface 1614 of the mid plate 160 may face at least a portion of the third portion 3103 of the antenna substrate 310. An adhesive member 164 may be disposed on the support surface 1614 so as to be interposed between the support surface 1614 and at least a portion of the third portion 3103 of the antenna substrate 310. The adhesive member 164 may include a bond or a double-sided adhesive tape.

Figure 14:
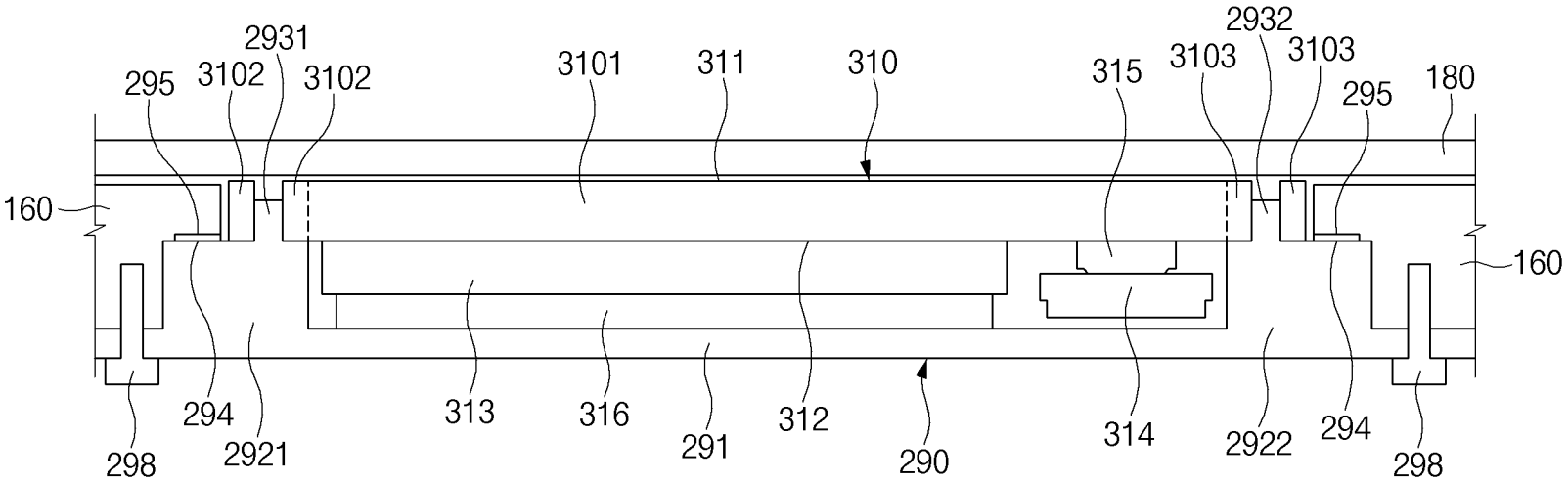
FIG. 14 is a sectional view illustrating how an example antenna module of an electronic device is disposed, according to various embodiments.

FIG. 14 is a diagram illustrating how the example antenna module 300 of an electronic device is disposed, according to various embodiments. FIG. 14 is a cross section taken along a line A-A' of FIG. 10.

Referring to FIG. 14, the antenna module 300 may include the antenna substrate 310, the wireless communication circuit 313, the connector 315, and the heat radiation member 316. The antenna substrate 310 may include the first surface 311 facing the second plate 180, and the second surface 312 facing away from the first surface 311, on which the wireless communication circuit 313 is disposed, and where the correspondence connector 315 is formed. The heat radiation member 316 may be disposed on one surface of the wireless communication circuit 313 for the purpose of cooling the wireless communication circuit 313. The connector 315 may be coupled to the connection member 314 (e.g., the first connector 2142 of FIG. 9). The antenna module 300 may be interposed between the second plate 180 and a coupling member 290 such that the first surface 311 of the antenna substrate 310 faces the second plate 180.

In the embodiment that is illustrated, the antenna substrate 310 may include the first portion 3101, and the second portion 3102 and the third portion 3103 formed around the first portion 3101. A hole may be formed at the second portion 3102 such that a first protrusion 2931 of the coupling member 290 is press-fitted therein, and a hole may be formed at the third portion 3103 such that a second protrusion 2932 of the coupling member 290 is press-fitted therein.

In the embodiment that is illustrated, the coupling member 290 may include a plate portion 291 facing the second plate 180, and a first support portion 2921 and a second support portion 2922, and at least a portion of each of the first and second support portions 2921 and 2922 may be formed between the antenna substrate 310 and the plate portion 291. Each of the first support portion 2921 and the second support portion 2922 may include a support surface 294 that faces the second plate 180 and of which at least a portion supports the second portion 3102 of the antenna substrate 310.

The first support portion 2921 and the second support portion 2922 may face each other, and at least a portion of the wireless communication circuit 313 may be interposed between the first support portion 2921 and the second support portion 2922. Referring to FIG. 14, the wireless communication circuit 313 and the heat radiation member 316 may be interposed between the first support portion 2921 and the second support portion 2922. Each of the first support portion 2921 and the second support portion 2922 may include the protrusion 2931 that is extended from the support surface 294 so as to be inserted into a hole formed at the second portion 3102 of the antenna substrate 310.

In various embodiments, the plate portion 291 may be in contact with the heat radiation member 316. The heat generated from the wireless communication circuit 313 may be transferred to the plate portion 291 through the heat radiation member 316.

In the embodiment that is illustrated, the electronic device may further include the mid plate 160 interposed between the second plate 180 and the coupling member 290. The opening 161 may be formed at the mid plate 160 such that at least a portion of the antenna module 300 is disposed therein. The opening 161 may include the first portion 1611 on which the antenna substrate 310 is disposed, and the second portion 1612 that is formed to be larger than the first portion 1611 and where the wireless communication circuit 313, the heat radiation member 316, the connector 315, and a portion of the coupling member 290 are disposed. The first portion 1611 of the opening 161 may be connected with the second portion 1612 of the opening 161 so as to be stepped, and the first portion 1611 and the second portion 1612 may form the stepped surface 1613.

A portion of the support surface 294 included in each of the first support portion 2921 and the second support portion 2922 may support the stepped surface 1613. In various embodiments, an adhesive member 295 may be interposed between the stepped surface 1613 and the support surface 294.

In the embodiment that is illustrated, the mid plate 160 and the coupling member 290 may be coupled as a screw 298 penetrates a surrounding region of the opening 161 formed at the mid plate 160 and the plate portion 291 corresponding to the surrounding region. An example is illustrated in FIG. 14 as the mid plate 160 is screw-coupled to the plate portion 291 of the coupling member 290, but the disclosure is not limited thereto. For example, the mid plate 160 may be coupled to the plate portion 291 in various manners.

A portion of the support surface 294 included in each of the first support portion 2921 and the second support portion 2922 may support the stepped surface 1613 of the mid plate 160, and the remaining portions of the support surfaces 294 of the first and second support portions 2921 and 2922 may support the second and third portions 3102 and 3103 of the antenna substrate 310, respectively.

Figure 15:
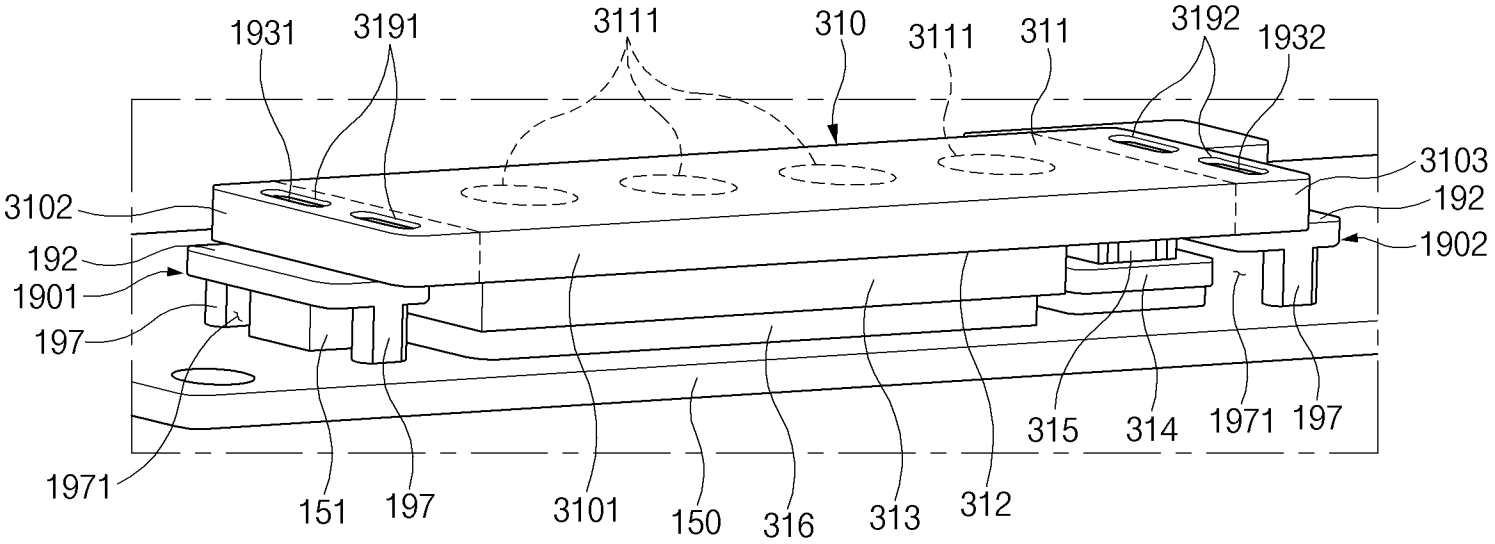
FIG. 15 is a perspective view illustrating how an example antenna module of an electronic device is disposed, according to various embodiments.

FIG. 15 is a diagram illustrating how the example antenna module 300 of an electronic device is disposed, according to an embodiment.

In the embodiment that is illustrated, the electronic device may include the printed circuit board 150, the antenna module 300 disposed on the printed circuit board 150, and a coupling member for fixing the antenna module 300.

In the embodiment that is illustrated, the antenna module 300 may include the antenna substrate 310 including the first portion 3101 including the first radiation region 3111 where an RF signal is radiated and the second portion 3102 formed around the first portion 3101 and including one or more holes formed therein, the wireless communication circuit 313, of which at least a portion is disposed on the second portion 3102, the heat radiation member 316 disposed on the wireless communication circuit 313, and the connector 315 electrically connected with the wireless communication circuit 313.

In the embodiment that is illustrated, the antenna substrate 310 may be disposed to be spaced from the printed circuit board 150 as much as a given distance. The first portion 3101 of the antenna substrate 310 may include the first surface 311 where the first radiation region 3111 is formed and the second surface 312 facing away from the first surface 311. The wireless communication circuit 313 and the heat radiation member 316 may be interposed between the second surface 312 of the antenna substrate 310 and the printed circuit board 150.

In the embodiment that is illustrated, the coupling member may include the first coupling member 1901 coupled to the second portion 3102 where the first hole 3191 is formed, and the second coupling member 1902 coupled to the second portion 3102 where the second hole 3192 is formed.

The first coupling member 1901 may include the support surface 192 supporting the second portion 3102 of the antenna substrate 310, the first protrusion 1931 extended from the support surface 192 to the interior of the first hole 3191, and an extension portion 197 extended from the support surface 192 to the printed circuit board 150.

The second coupling member 1902 may include the support surface 192 supporting the third portion 3103 of the antenna substrate 310, the second protrusion 1932 extended from the support surface 192 to the interior of the second hole 3192, and the extension portion 197 extended from the support surface 192 to the printed circuit board 150.

In various embodiments, the extension portion 197 may include a plurality of extension portions 197, and the plurality of extension portions 197 may be spaced from each other as much as a given distance. A space 1971 may be formed between the plurality of extension portions 197, the support surface 192, and the printed circuit board 150. In various embodiments, one or more electrical components 151 may be disposed on the printed circuit board 150 included in the space 1971.

In an embodiment, each of the coupling members 1901 and 1902 may include the first support surface 192 supporting a peripheral portion (e.g., the second portion 3102 or the third portion 3103) of the antenna substrate 310 and a second support surface supported by the printed circuit board 150, and the second support surface may include a recess (e.g., the space 1971) where an electrical component is able to be disposed.

In the embodiment that is illustrated, the coupling members 1901 and 1902 of the electronic device may provide a recess, an opening, or the space 1971 where the electrical components 151 are able to be disposed, and thus, the mounting area of the printed circuit board 150 may be efficiently utilized.

Figure 16A:
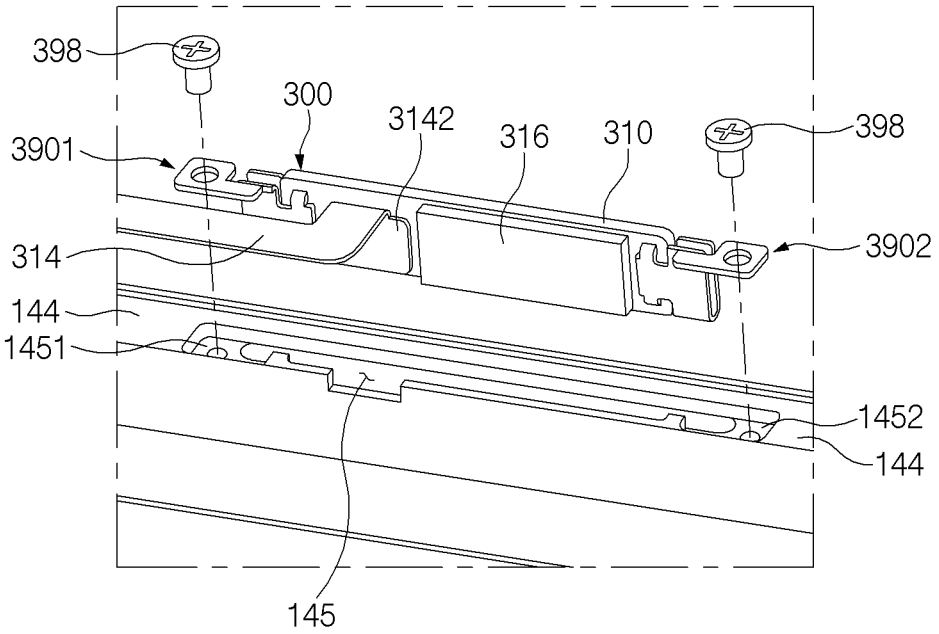
FIGS. 16A, 16B and 16C are diagrams illustrating how an example antenna module of an electronic device is disposed, according to various embodiments.
Figure 16B:
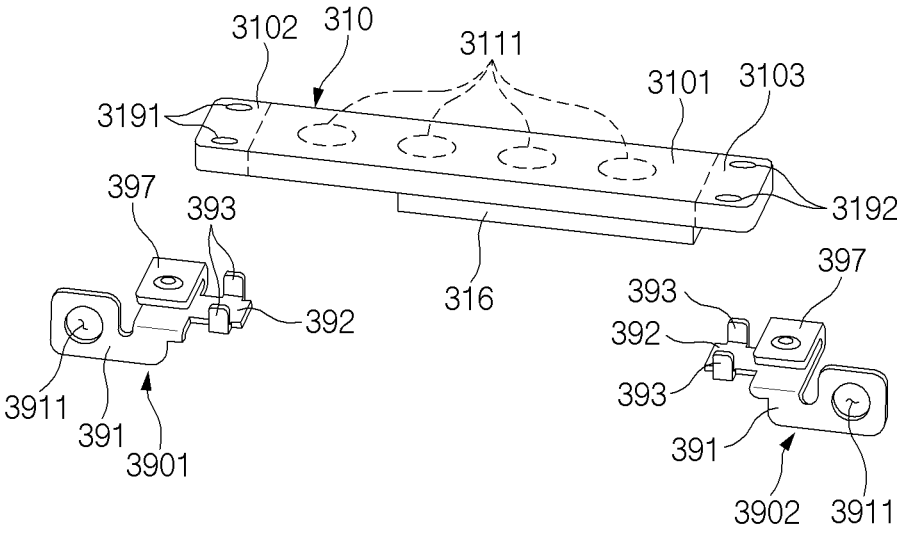
Figure 16C:
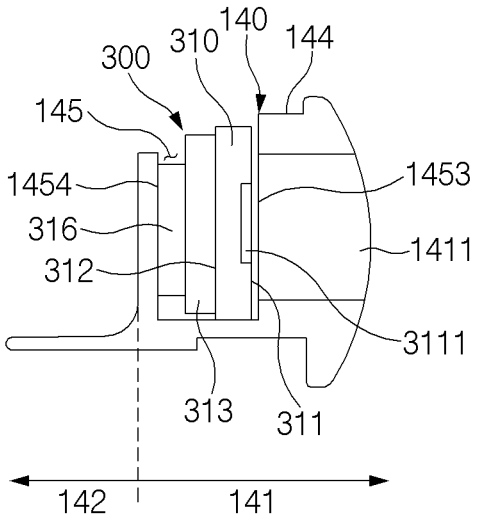

FIGS. 16A, 16B and 16C are diagrams illustrating how the example antenna module 300 of an electronic device is disposed, according to various embodiments.

Referring to FIGS. 16A, 16B and 16C, the side member 140 may be formed between a first plate (e.g., the front plate 120 of FIG. 3) forming a first surface (e.g., a front surface) of an electronic device and a second plate (e.g., the rear plate 180 of FIG. 3) forming a second surface (e.g., a back surface) of the electronic device. The side member 140 may include the first structure 141 forming an outer surface (e.g., a side surface) of the electronic device and the second structure 142 extended from the first structure 141 to the interior of the electronic device (e.g., the interior of the housing 110 of FIG. 1). The first structure 141 may include a first surface facing the first plate (e.g., the first plate 120 of FIG. 3), and a second surface 144 facing the second plate (e.g., the second plate 180 of FIG. 3).

The antenna module 300 may include the antenna substrate 310, the wireless communication circuit 313, and the heat radiation member 316. The antenna substrate 310 may include the first portion 3101 where the first radiation region 3111 is formed, the second portion 3102 where the first hole 3191 is formed, and the third portion 3103 where the second hole 3192 is formed. The antenna substrate 310 may include the first surface 311 where the first radiation region 3111 is formed and the second surface 312 facing away from the first surface 311. The wireless communication circuit 313 may be disposed on the second surface 312 of the antenna substrate 310. The heat radiation member 316 may be disposed on the wireless communication circuit 313.

In various embodiments, a recess 145 may be formed at a portion of the second surface 144 of the side member 140. The recess 145 may include a first inner side wall 1453, and a second inner side wall 1454 facing the first inner side wall 1453 and located to be closer to the inside of the electronic device than the first inner side wall 1453.

The antenna module 300 may be disposed in the recess 145 such that the first surface 311 of the antenna substrate 310 faces the first inner side wall 1453 (e.g., facing an outer side of the electronic device) and such that the second surface 312 of the antenna substrate 310 faces the second inner side wall 1454 (e.g., facing an inner side of the electronic device). Referring to FIGS. 16A, 16B and 16C, the wireless communication circuit 313 and the heat radiation member 316 may be interposed between the second surface 312 of the antenna substrate 310 and the second inner side wall 1454.

In various embodiments, a first support surface 1451 and a second support surface 1452 on which coupling members 3901 and 3902 are disposed may be formed around the recess 145. In this case, like the second surface 144 of the side member 140, the first support surface 1451 and the second support surface 1452 may face the second plate 180. The first support surface 1451 and the second support surface 1452 may be formed to form steps with surrounding portions thereof toward the first plate.

In various embodiments, the electronic device may further include the coupling members 3901 and 3902 for coupling the antenna module 300 to the side member 140. The coupling members 3901 and 3902 may include the first coupling member 3901 coupled to the second portion 3102 of the antenna substrate 310 and the second coupling member 3902 coupled to the third portion 3103 of the antenna substrate 310.

The first coupling member 3901 may include a fixing portion 391 disposed on the first support surface 1451 of the recess 145, an extension portion 392 extended from the fixing portion 391 at a given angle and of which at least a portion is disposed at the second portion 3102 of the antenna substrate 310, and a protrusion 393 extended from the extension portion 392 to the interior of the first hole 1391 formed at the second portion 3102 of the antenna substrate 310. In various embodiments, the extension portion 392 may be extended from the fixing portion 391 substantially vertically. The first coupling member 3901 may be disposed such that the fixing portion 391 faces the second plate 180 and the extension portion 392 faces the first inner side wall 1453 of the recess 145. The protrusion 393 may be formed from the extension portion 392 in a direction facing the first inner side wall 1453. As the protrusion 393 is inserted into the first hole 3191 formed at the second portion 3102 of the antenna substrate 310, the first coupling member 3901 may be coupled to the antenna substrate 310.

The second coupling member 3902 may include the fixing portion 391 disposed on the second support surface 1452 of the recess 145, the extension portion 392 extended from the fixing portion 391 at a given angle and at least a portion of which is disposed at the third portion 3103 of the antenna substrate 310, and the protrusion 393 extended from the extension portion 392 to the interior of the second hole 1392 formed at the third portion 3103 of the antenna substrate 310. In various embodiments, the extension portion 392 may be extended from the fixing portion 391 substantially vertically. The second coupling member 3902 may be disposed such that the fixing portion 391 faces the second plate 180 and the extension portion 392 faces the first inner side wall 1453 of the recess 145. The protrusion 393 may be formed from the extension portion 392 in a direction facing the first inner side wall 1453. As the protrusion 393 is inserted into the second hole 3192 formed at the third portion 3103 of the antenna substrate 310, the second coupling member 3902 may be coupled to the antenna substrate 310.

A fastening hole 3911 into which a fastening member 398 is able to be inserted may be formed at the fixing portion 391 of each of the first coupling member 3901 and the second coupling member 3902. For example, the fastening member 398 may include a screw, and the fastening hole 3911 may include a screw hole corresponding to the screw.

Each of first coupling member 3901 and the second coupling member 3902 may further a bending portion 397 providing an elastic force such that the extension portion 392 is strongly coupled in the recess 145. The bending portion 397 may be extended from one side of the extension portion 392 and may be bent and formed to face the extension portion 392. The bending portion 397 and the extension portion 392 may be connected in substantially a "U" shape. At least a portion of the bending portion 397 may be supported by the first inner side wall 1453 of the recess 145. In various embodiments, the antenna module 300 may be disposed in the recess 145 such that the bending portions 397 of the coupling members 3901 and 3902 are supported by the first inner side wall 1453 of the recess 145 and such that the extension portions 392 of the coupling members 3901 and 3902 are supported by the second inner side wall 1454 of the recess 145. In this case, the bending portion 397 and the extension portion 392 may be formed to provide an elastic force to the first inner side wall 1453 and the second inner side wall 1454. The antenna module 300 may be strongly fixed in the recess 145 formed at the side member 140 through the elastic force that the extension portions 392 and the bending portions 397 of the coupling members 3901 and 3902 provide.

In the embodiment that is illustrated, at least a portion of the first structure 141 of the side member 140 may include a non-conductive portion 1411 formed of a non-conductive material. For example, the non-conductive portion 1411 may include a portion of the antenna module 300, which faces the first surface 311 of the antenna substrate 310. The non-conductive portion 1411 may be formed of a non-conductive material that does not have an influence on radiating an RF signal from the first radiation region 3111. For example, the non-conductive material may include a poly carbonate material.

According to various example embodiments, an electronic device may include a housing that includes a first plate facing a first direction, a second plate facing a second direction opposite the first direction, and a side housing surrounding a space between the first plate and the second plate, wherein the second plate includes an outer surface facing the second direction and being substantially flat and an inner surface facing the first direction and being substantially flat, an inner plate interposed between the first plate and the second plate, wherein the inner plate includes a surface facing the inner surface of the second plate and an opening, an antenna structure comprising a substrate including a first surface facing the inner surface of the second plate and a second surface facing away from the inner surface, at least one conductive pattern on the first surface and/or embedded in the substrate, a first surrounding portion of the substrate including a first hole penetrating the second surface, and a second surrounding portion of the substrate including a second hole penetrating the second surface, the antenna structure being disposed in the opening, a first support coupler including a first portion, of which at least a portion is located between the first surrounding portion and the first plate, and a first protrusion extending to an interior of the first hole, a second support coupler including a second portion, of which at least a portion is located between the second surrounding portion and the first plate, and a second protrusion extending to an interior of the second hole, and a wireless communication circuit electrically connected to the conductive pattern and mounted on the second surface.

In various example embodiments, the wireless communication circuit may be mounted on the second surface between the first surrounding portion and the second surrounding portion, when viewed from above the second surface.

In various example embodiments, the first support coupler may be maintained by a first portion (e.g., the stepped surface 1613) of the inner (e.g., the mid structure 160) plate such that the first support coupler is configured to resist movement to the inner surface, and the second support coupler may be maintained by a second portion (e.g., the stepped surface 1613) of the inner (e.g., the mid structure 160) plate such that the second support coupler is configured to resist movement to the inner surface.

In various example embodiments, the first support coupler may include a first flange (e.g., the second support surface 192 included in the first coupling member 1901) including a surface not overlapping the substrate and facing the inner surface, when viewed from above the second plate, and the second support coupler may include a second flange (e.g., the second support surface 192 included in the second coupling member 1902) including a surface not overlapping the substrate and facing the inner surface, when viewed from above the second plate.

In various example embodiments, the first portion of the inner (e.g., the mid plate 160) plate may include a surface facing the first flange (e.g., the second support surface 192 included in the first coupling member 1901), and the second portion of the inner (e.g., the mid plate 160) plate may include a surface facing the second flange (e.g., the second support surface 192 included in the second coupling member 1902).

In various example embodiments, at least a portion (e.g., the press-fitting portion 194) of the first portion (e.g., the protrusion 1931) of the first support coupler may be larger in size than the first hole, and at least a portion (e.g., the press-fitting portion 194) of the second portion (e.g., the protrusion 1902) of the second coupling member may be larger in size than the second hole.

In various example embodiments, the electronic device may further include an adhesive member interposed between the surface of the first flange (e.g., the second support surface 192 included in the first coupling member 1901) and the surface of the first portion (e.g., the stepped surface 1613) of the inner plate (e.g., the mid plate 160).

In various example embodiments, the electronic device may further include a printed circuit board interposed between the first plate and the inner plate (e.g., the mid plate 160), and the first support coupler and the second support coupler may be respectively disposed on the printed circuit board.

In various example embodiments, the side housing may include a first portion adjacent to the substrate of the antenna structure (e.g., the antenna module 300), and the antenna structure (e.g., the antenna module 300) may be disposed adjacent to the side housing such that the first support coupler and the second support coupler are spaced from the first portion of the side housing by as much as the same distance.

Figure 17:
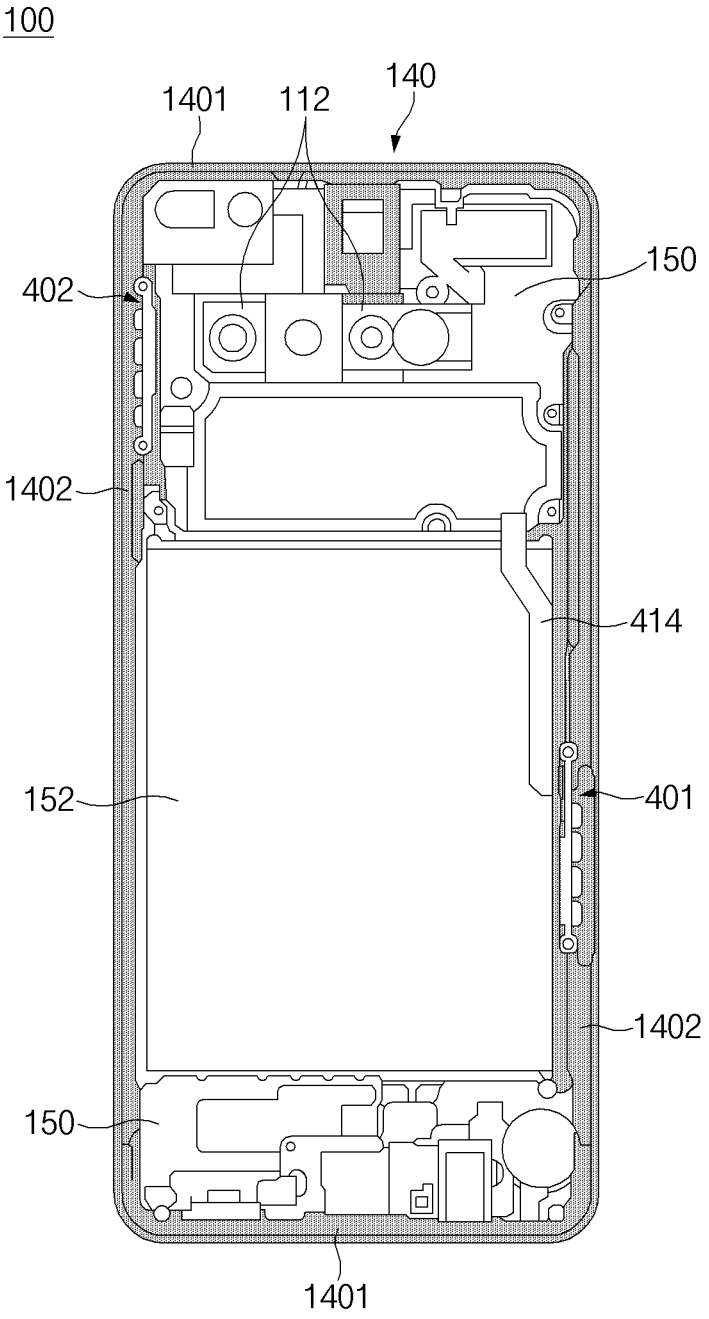
FIG. 17 is a diagram illustrating how an example antenna module of an electronic device is disposed, according to various embodiments.

FIG. 17 is a diagram illustrating how example antenna modules 401 and 402 of the electronic device 100 are disposed, according to various embodiments.

The electronic device 100 according to the embodiment illustrated may include the printed circuit board 150 on which one or more electrical components are mounted, the battery 152, the side member 140 surrounding the printed circuit board 150 and the battery 152, and the one or more antenna modules 401 and 402 disposed at the side member 140. In various embodiments, the one or more electrical components may include a camera module 112. In various embodiments, the side member 140 may be formed to surround a space between a first plate (e.g., the first plate 120 of FIG. 3) and a second plate (e.g., the second plate 180 of FIG. 3). The printed circuit board 150 and the battery 152 may be disposed in the space.

The side member 140 may include a pair of short-side portions 1401 extended with a first length and a pair of long-side portions 1402 extended with a second length longer than the first length. The short-side portions 1401 and the long-side portions 1402 may be substantially perpendicular to each other.

The antenna modules 401 and 402 may include a second antenna module 402 adjacent to the camera module 112 and disposed at a portion of the side member 140, and a first antenna module 401 adjacent to the battery 152 and disposed at a portion of the side member 140.

In various embodiments, the second antenna module 402 may be coupled to one, which is adjacent to the camera module 112, from among the pair of long-side portions 1402 of the side member 140, and the first antenna module 401 may be coupled to the other, which is adjacent to the battery 152, from among the pair of long-side portions 1402 of the side member 140.

In various embodiments, the first antenna module 401 and the second antenna module 402 may be respectively disposed at the pair of long-side portions 1402 facing each other, so as to radiate radio waves in different directions. For example, the first antenna module 401 may be disposed on the right with respect to the battery 152 and the camera module 112, and the second antenna module 402 may be disposed on the left with respect to the battery 152 and the camera module 112. For example, the first antenna module 401 and the second antenna module 402 may be configured to radiate radio waves in a direction that is opposite to a direction facing the printed circuit board 150 and the battery 152. As such, the electronic device 100 may have a radiation range in various directions.

Figure 18A:
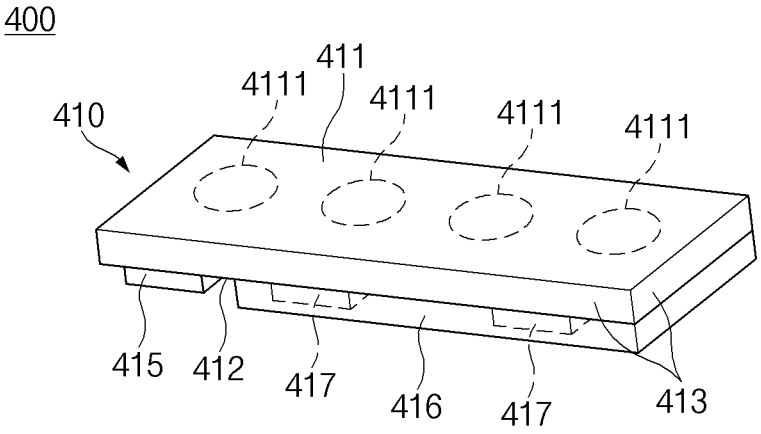
FIGS. 18A, 18B and 18C are diagrams illustrating how an example antenna module of an electronic device is disposed, according to various embodiments.
Figure 18B:
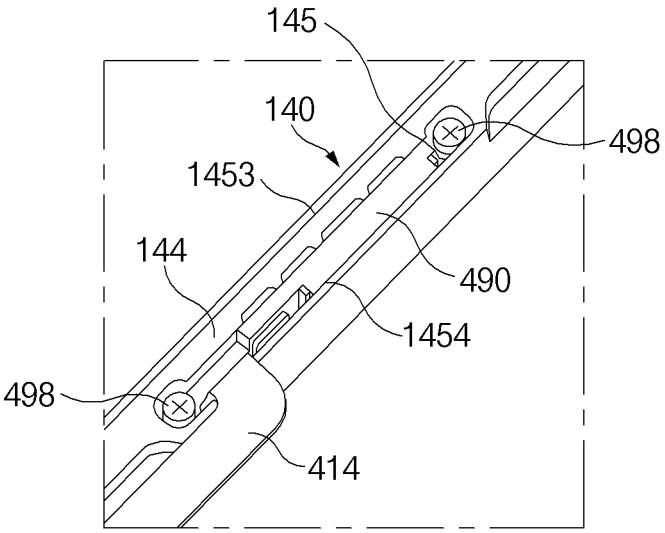
Figure 18C:
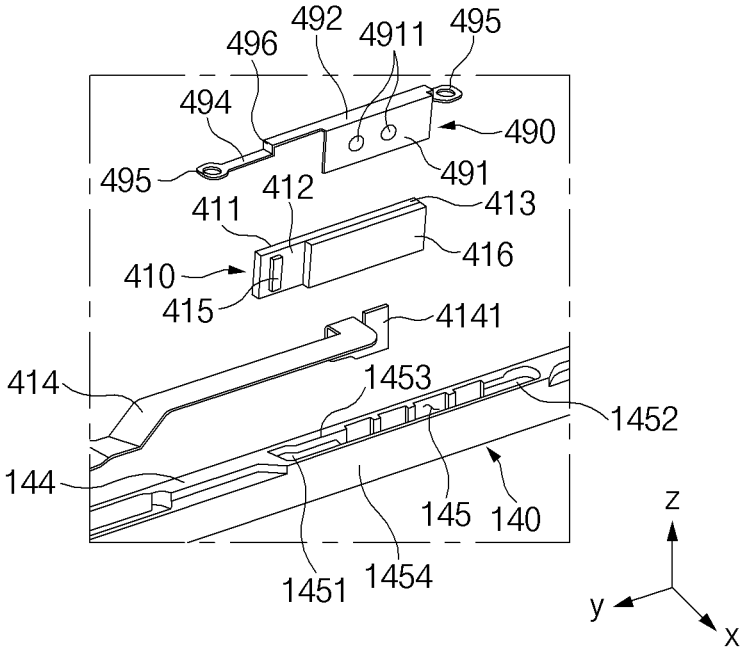

FIGS. 18A, 18B and 18C are diagrams illustrating an example antenna module 400 of the electronic device 100 and the side member 140 where the antenna module 400 is disposed, according to various embodiments.

Here, the antenna module 400 may include at least one of the first antenna module 401 and the second antenna module 402 illustrated in FIG. 17.

Referring to FIG. 18A, the electronic device 100 according to various embodiments may include the side member 140 where the recess 145 is formed, the antenna module 400 disposed in the recess 145, and a bracket 490 fixing the antenna module 400 to the side member 140.

The side member 140 may include a first plate (e.g., a first surface (not illustrated) facing the first plate 120 of FIG. 3), and a second plate (e.g., the second surface 144 facing the second plate 180 of FIG. 3).

In various embodiments, the side member 140 may include the recess 145 formed on the second surface 144. The recess 145 may include the first inner side wall 1453, and the second inner side wall 1454 facing the first inner side wall 1453 and located to be closer to the inside of the electronic device than the first inner side wall 1453.

Referring to FIGS. 18A and 18B, the antenna module 400 may include an antenna substrate 410, a wireless communication circuit 417, a heat radiation member 416, and a FPCB 414. The antenna substrate 410 may include a first surface 411 where a radiation region 4111 is formed, a second surface 412 facing away from the first surface 411, and a third surface 413 between the first surface 411 and the second surface 412. A connector 415 to which the wireless communication circuit 417 and the FPCB 414 are connected may be formed on the second surface 412 of the antenna substrate 410. The heat radiation member 416 may be disposed on the wireless communication circuit 417.

In the embodiment that is illustrated, the antenna module 400 may be disposed in the recess 145 such that the first surface 411 of the antenna substrate 410 faces the first inner side wall 1453 (e.g., facing an outer side of the electronic device 100) and such that the second surface 412 of the antenna substrate 410 faces the second inner side wall 1454 (e.g., facing an inner side of the electronic device 100). Referring to FIGS. 18A, 18B and 18C, the wireless communication circuit 417 and the heat radiation member 416 may be interposed between the second surface 412 of the antenna substrate 410 and the second inner side wall 1454.

In various embodiments, the first support surface 1451 and the second support surface 1452 on which the bracket 490 is disposed may be formed around the recess 145. In this case, like the second surface 144 of the side member 140, the first support surface 1451 and the second support surface 1452 may face the second plate (e.g., the second plate 180 of FIG. 3). The first support surface 1451 and the second support surface 1452 may be formed to form steps with surrounding portions thereof (e.g., the second surface 144 of the side member 140) toward the first plate (e.g., the first plate 120 of FIG. 3).

Referring to FIG. 18C, at least a portion of the bracket 490 may be inserted into the recess 145 so as to surround the antenna module 400. The bracket 490 may include an insertion portion 491, of which at least a portion is inserted into the recess 145, and that supports the heat radiation member 416 disposed on the second surface 412 of the antenna substrate 410, a support portion 492 that is extended from the insertion portion 491 and supports the third surface 413 of the antenna substrate 410, and a fixing portion 494 that is extended from the support portion 492 and is fixed to the first support surface 1451 and the second support surface 1452.

In various embodiments, the insertion portion 491 may be formed such that the insertion portion 491 is inserted between the heat radiation member 416 disposed on the second surface 412 of the antenna substrate 410 and the second inner side wall 1454, the support portion 492 may be formed in substantially the same direction as the second surface 412 of the side member 140 so as to surround the third surface 413 of the antenna substrate 410, and the fixing portion 494 may be extended from the support portion 492 so as to be stepped in a direction facing the first plate (e.g., the first plate 120 of FIG. 3). The fixing portion 494 and the support portion 492 may form a stepped surface 496, and the stepped surface 496 may surround a portion of the third surface 413 of the antenna substrate 410. In various embodiments, the insertion portion 491 may be formed to have a size substantially corresponding to the heat radiation member 416. The fixing portion 494 may include a fastening hole 495 into which a fastening member 498 may be inserted. The fastening member 498 may be coupled to the support surfaces 1451 and 1452 through the fastening hole 495. In the embodiment that is illustrated, the fastening member 498 may include a screw.

In various embodiments, the support portion 492 may be formed in a direction substantially perpendicular to the insertion portion 491. The fixing portion 494 may be formed on a surface that faces substantially the same direction as the support portion 492. For example, the insertion portion 491 may be formed at a plate facing an x-axis direction, the support portion 492 may be formed at a plate facing a z-axis direction, the stepped surface 496 may be formed at a plate facing a y-axis direction, and the fixing portion 494 may be formed at a plate facing the z-axis direction.

In the embodiment that is illustrated, the antenna module 400 may be disposed in the recess 145 such that the first surface 411 of the antenna substrate 410 faces the first inner side wall 1453, such that the second surface 412 of the antenna substrate 410 faces the second inner side wall 1454, such that a portion, which faces the z-axis direction, of the third surface 413 of the antenna substrate 410 faces the support portion 492, and such that a portion, which faces the y-axis direction, of the third surface 413 of the antenna substrate 410 faces the stepped surface 496.

In various embodiments, the insertion portion 491 may include a fixing protrusion 4911 that protrudes toward the second inner side wall 1454. As the fixing protrusion 4911 is inserted into a correspondence groove (not illustrated) formed on the second inner side wall 1454, locations of the bracket 490 in the y-axis direction and the z-axis direction may be fixed. Meanwhile, as the bracket 490 is inserted between the first inner side wall 1453 and the second inner side wall 1454 together with the antenna module 400, a location of the bracket 490 in the x-axis direction may be fixed.

In various embodiments, the insertion portion 491 may be formed substantially to cover the heat radiation member 416 and not to cover the connector 415. A correspondence connector 4141 of the FPCB 414 may be coupled to the connector 415 of the antenna substrate 410, and the correspondence connector 4141 of the FPCB 414 may be supported by the second inner side wall 1454. As such, the correspondence connector 4141 of the FPCB 414 may be strongly coupled to the connector 415 of the antenna substrate 410.

Figure 19:
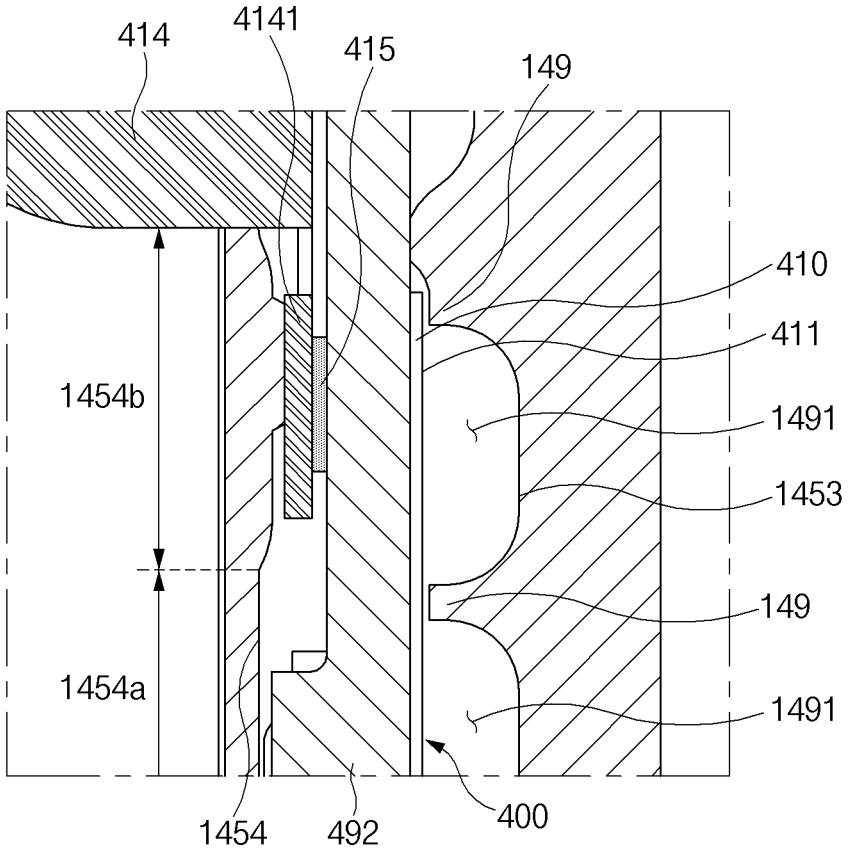
FIG. 19 is a diagram illustrating how an example antenna module and a flexible printed circuit board (FPCB) of an electronic device are coupled, according to various embodiments.

FIG. 19 is a diagram illustrating how the example antenna module 400 and the FPCB 414 of the electronic device 100 are coupled, according to various embodiments.

Here, the antenna module 400 may include at least one of the first antenna module 401 and the second antenna module 402 illustrated in FIG. 17.

Referring to FIG. 19, the FPCB 414 may include the correspondence connector 4141 that is coupled to the connector 415 formed on the second surface 412 of the antenna substrate 410. The correspondence connector 4141 of the FPCB 414 may be supported between the connector 415 and the second inner side wall 1454. The correspondence connector 4141 of the FPCB 414 and the connector 415 of the antenna substrate 410 may be inserted and fixed between the second surface 412 of the antenna substrate 410 and the second inner side wall 1454.

In various embodiments, the second inner side wall 1454 may include a first region 1454*a* corresponding to the insertion portion 491 of the bracket 490 and a second region 1454*b* corresponding to the connector 415 of the antenna substrate 410. In this case, the second region 1454*b* may further include a press region that protrudes toward the antenna substrate 410 and presses the correspondence connector 4141 of the FPCB 414 toward the connector 415.

In various embodiments, the heat radiation member 416 may further protrude from the second surface 412 of the antenna substrate 410 to the second inner side wall 1454 compared with the connector 415. As such, the second region 1454*b* may further protrude toward the second surface 412 of the antenna substrate 410 compared with the first region 1454*a*.

In the embodiment that is illustrated, the second region 1454*b* may press the correspondence connector 4141 of the FPCB 414 toward the connector 415 of the antenna substrate 410 such that an electrical connection of the FPCB 414 and the antenna substrate 410 is stably maintained.

The electronic device 100 according to various embodiments may include a coupling structure of the antenna module 400 that is formed such that the correspondence connector 4141 of the FPCB 414 is not departed from the connector 415 of the antenna substrate 410 and the second inner side wall 1454 presses the correspondence connector 4141 of the FPCB 414.

Figure 20A:
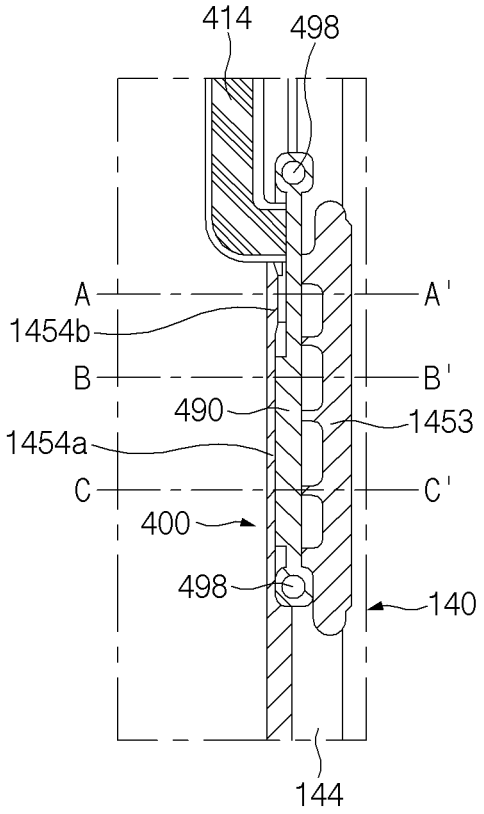
FIGS. 20A, 20B, 20C and 20D are diagrams illustrating how an example antenna module and a housing of an electronic device are coupled, according to various embodiments.
Figure 20B:
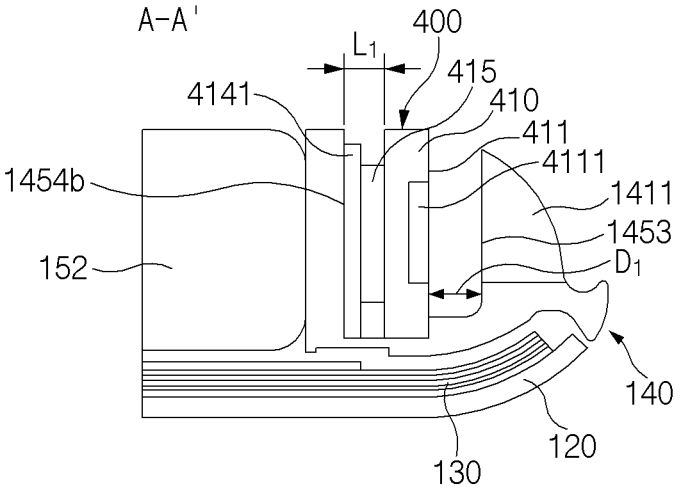
Figure 20C:
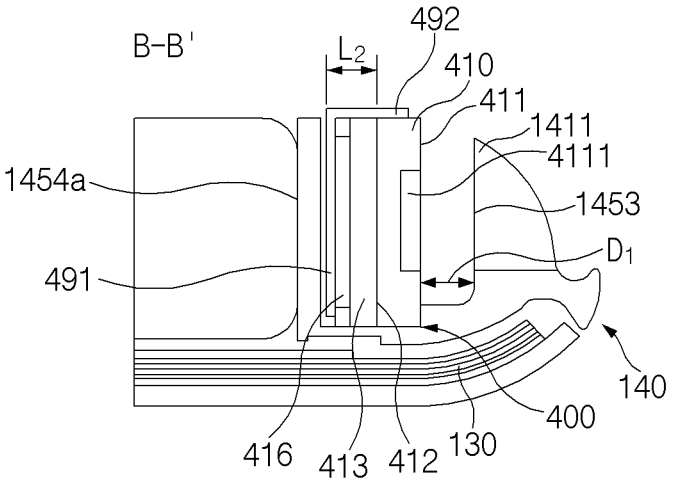
Figure 20D:
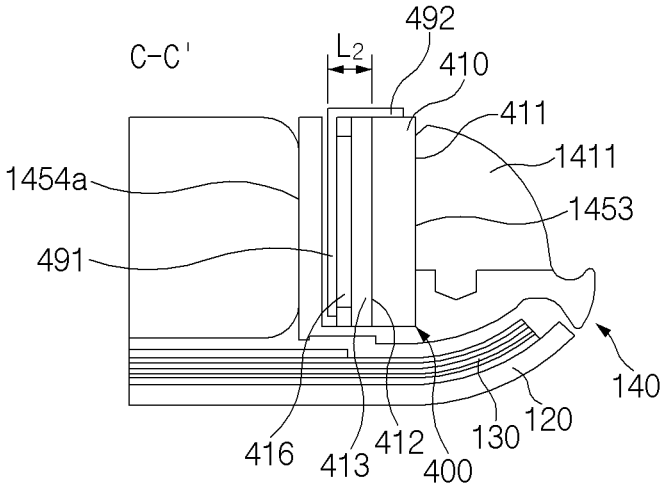

FIGS. 20A, 20B, 20C and 20D are diagrams illustrating how the example antenna module 400 and a housing of the electronic device 100 are coupled, according to various embodiments. FIG. 20B is a cross-sectional view illustrating how the connector 415 and the correspondence connector 4141 are disposed. FIGS. 20C and 20D are cross-sectional views illustrating how the first surface 411 of the antenna substrate 410 and the non-conductive portion 1411 are disposed.

Referring to FIG. 20A, the second inner side wall 1454 may include the first region 1454*a* corresponding to the insertion portion 491 of the bracket 490 and the second region 1454*b* corresponding to the connector 415 of the antenna substrate 410. As described above, in the case where a first thickness L1 of the connector 415 and the correspondence connector 4141 is thicker than a second thickness L2 of the wireless communication circuit 417, the heat radiation member 416, and the insertion portion 491 of the bracket 490, the second region 1454*b* pressing the correspondence connector 4141 may further protrude toward the second surface 412 of the antenna substrate 410 compared with the first region 1454*a*.

Referring to FIGS. 20A, 20C, and 20D, the antenna module 400 may be inserted into the recess 145 formed on the second surface 412 of the side member 140. The antenna module 400 may be disposed such that the first surface 411 of the antenna substrate 410 faces the first inner side wall 1453 and such that the second surface 412 of the antenna substrate 410 faces the second inner side wall 1454.

The insertion portion 491 of the bracket 490 may be interposed between the heat radiation member 416 formed on the second surface 412 of the antenna substrate 410 and the second insertion portion 491, and the support portion 492 of the bracket 490 may cover the antenna substrate 410.

In the embodiment that is illustrated, the first inner side wall 1453 may include a protrusion 149 that protrudes toward the first surface 411 of the antenna substrate 410. The protrusion 149 may support a portion of the first surface 411 of the antenna substrate 410. For example, the protrusion 149 may protrude between the plurality of radiation regions 4111 formed on the first surface 411 of the antenna substrate 410. As such, the protrusion 149 may fix a location of the antenna substrate 410 while having no influence on radiation performance.

In an embodiment, a conductive pattern defining the radiation region 4111 may be formed on the first surface 411 of the antenna substrate 410. In this case, when the first inner side wall 1453 directly contacts the first surface 411, the conductive pattern formed on the first surface 411 may be damaged, and the radiation performance may decrease. Accordingly, the protrusion 149 may be formed on the first inner side wall 1453 so as to protrude between the radiation regions 4111 or conductive patterns.

In various embodiments, a groove 1491 may be formed between the protrusions 149 formed on the first inner side wall 1453, and the groove 1491 may be formed at a region corresponding to the radiation region 4111 of the antenna substrate 410.

The electronic device 100 according to various embodiments may include a coupling structure of the antenna module 400 that is formed such that the radiation region 4111 or the conductive pattern defining the radiation region 4111 is not damaged and such that the first inner side wall 1453 supports the region between the radiation regions 4111 or the conductive patterns.

In various embodiments, the side member 140 may include the non-conductive portion 1411 formed of a non-conductive material. The non-conductive portion 1411 may correspond to the radiation region 4111 of the antenna module 400. For example, the non-conductive portion 1411 may include a polycarbonate material so as not to have an influence on radiating an RF signal from the first radiation region 4111.

According to various example embodiments, an electronic device may include a housing that includes a first plate facing a first direction, a second plate facing a second direction opposite the first direction, and a side housing surrounding a space between the first plate and the second plate, wherein the second plate includes an outer surface facing the second direction and being substantially flat and an inner surface facing the first direction and being substantially flat, an inner plate (e.g., the mid plate 160) interposed between the first plate and the second plate, wherein the inner plate (e.g., the mid plate 160) includes a surface facing the inner surface of the second plate and an opening 161, an antenna structure (e.g., the antenna module 300) comprising a substrate including a first surface facing the inner surface of the second plate and a second surface facing away from the inner surface, at least one conductive pattern formed on the first surface and/or embedded in the substrate, and at least one hole penetrating the second surface, the antenna structure being disposed in the opening, at least one support coupler including a first portion (e.g., the support surface 192) at least partially located between the substrate and the first plate and a protrusion (e.g., the protrusion 193) extending to an interior of the hole, and a wireless communication circuit 313 electrically connected to the conductive pattern and mounted on the second surface.

According to various example embodiments, an electronic device may include a housing including a first plate, a second plate facing the first plate, and a side housing surrounding a space between the first plate and the second plate, a printed circuit board disposed in the space, and an antenna module including an antenna substrate and a wireless communication circuit. The antenna substrate may include a first surface including a radiation region where an RF signal is radiated, a second surface facing away from the first surface in which a coupling hole is formed, and a conductive pattern comprising the radiation region. The wireless communication circuit may be disposed on the second surface of the antenna substrate and may be electrically connected with the conductive pattern. The antenna substrate may include an antenna module comprising at least one antenna disposed between the printed circuit board and the second plate such that the first surface faces the second plate and the second surface faces the printed circuit board 150 and a support coupler disposed on the printed circuit board. The support coupler may be coupled to the antenna substrate and may include a protrusion inserted into the coupling hole on the second surface of the antenna substrate.

In various example embodiments, the hole may be formed around a region, which corresponds to the radiation region formed on the first surface, of the second surface.

In various example embodiments, the hole may penetrate the second surface and the first surface, and the hole penetrating the first surface may be formed around the radiation region.

In various example embodiments, the hole may include a first hole formed on one side of the radiation region and a second hole formed on an opposite side thereof, the support coupler may include a first support coupler including a first protrusion inserted into the first hole and a second protrusion inserted into the second hole, and the first support coupler and the second support coupler may be respectively spaced from an inner side surface of the side housing as much as the same distance.

In various example embodiments, the antenna substrate may include a plurality of layers including the first surface and the second surface, and the conductive pattern may be formed in at least one of the plurality of layers.

In various example embodiments, at least a portion of the support coupler may include a support surface (e.g., the second support surface 192) supporting the second surface of the antenna substrate, and the protrusion may extend from the support surface to an interior of the hole.

In various example embodiments, the protrusion may be press-fitted in the hole, and at least a portion of the protrusion may further protrude in a direction facing an inner surface of the hole so as to press an inner side surface of the hole.

In various example embodiments, the electronic device may further include a mid plate interposed between the printed circuit board and the second plate and in which at least one or more opening is formed, the antenna substrate may be disposed in the opening, and at least a portion (e.g., the stepped surface 1613) of a surrounding region of the opening may be supported by at least a portion of the support surface of the coupling member.

In various embodiments, the side housing may include a first portion forming an outer surface of the electronic device and a second portion extending from the first structure to the space, the printed circuit board 150 may be interposed between the second portion and the second plate, and the mid plate may be interposed between the printed circuit board and the second plate.

According to various example embodiments, an electronic device may include a housing including a first plate, a second plate facing away from the first plate, and a side housing surrounding a space between the first plate and the second plate, and an antenna substrate including a first portion including a conductive pattern, a first surface where an RF signal is radiated by the conductive pattern, and a second surface facing away from the first surface, a second portion of the antenna substrate formed at at least a portion of an edge of the first portion and in which a first hole is formed, and a third portion of the antenna substrate formed at at least a portion of an edge of the first portion and in which a second hole is formed. The side housing may include a first surface facing the first plate, a second surface facing the second plate, and a recess formed on the second surface. The recess may include a first inner side wall, and a second inner side wall facing the first inner side wall and formed to be closer to an inside of the housing than the first inner side wall. The electronic device may further include a support coupler configured to fix the antenna substrate in the recess such that the first surface of the antenna substrate faces the first inner side wall and the second surface of the antenna substrate faces the second inner side wall. The support coupler may include a first support coupler that includes a fixing portion configured to be fixed to a first surrounding portion of the recess and facing the second plate, an extension portion extending from the fixing portion to an interior of the recess and facing the first inner side wall, and a first protrusion protruding from the extension portion in a direction facing the first inner side wall and inserted into the first hole of the antenna substrate, and a second support coupler that includes a fixing portion fixed to a second surrounding portion of the recess and facing the second plate, an extension portion extending from the fixing portion to the interior of the recess and facing the first inner side wall, and a second protrusion protruding from the extension portion in a direction facing the first inner side wall and inserted into the second hole of the antenna substrate.

In various example embodiments, the support coupler may further include a bending portion connected with the extension portion and facing the extension portion, the support coupler may be interposed between the first inner side wall and the second inner side wall such that the extension portion presses one of the first inner side wall and the second inner side wall and the bending portion presses the other of the first inner side wall and the second inner side wall.

According to various example embodiments, an electronic device may include a housing including a first plate, a second plate facing away from the first plate, and a side housing surrounding a space between the first plate and the second plate, an antenna substrate including a conductive pattern, a first surface including a radiation region where an RF signal is radiated by the conductive pattern, a second surface facing away from the first surface, and a third surface formed between the first surface and the second surface, and a bracket configured to fix the antenna substrate to the side housing, the side housing may include a first surface facing the first plate, a second surface facing the second plate, and a recess formed on the second surface, the recess may include a first inner side wall, and a second inner side wall facing the first inner side wall and formed to be closer to an inside of the housing than the first inner side wall, the antenna substrate may be disposed in the recess such that the first surface faces the first inner side wall, the second surface faces the second inner side wall, and the third surface faces the second plate, and the bracket may include an insertion portion inserted between the second surface of the antenna substrate and the second inner side wall, a support portion extending from the insertion portion and covering at least a portion of the third surface of the antenna substrate, and a fixing portion extending from the support portion and fixed to the second surface of the side member.

In various example embodiments, the electronic device may further include an FPCB including a heat radiator disposed on the second surface of the antenna substrate, a connector disposed on the second surface of the antenna substrate 410 and a correspondence connector coupled to the connector, wherein at least a portion of the FPCB is disposed in the recess, the second inner side wall may include a first region corresponding to the heat radiation member and a second region corresponding to the correspondence connector of the FPCB, and the second region may protrude toward the second surface of the antenna substrate with respect to the first region, so as to press the correspondence connector toward the connector.

In various example embodiments, the first inner side wall may include protrusions contacting the first surface of the antenna substrate and a groove formed between the protrusions.

The electronic device according to various embodiments disclosed in the disclosure may be various types of devices. The electronic device may include, for example, and without limitation, a portable communication device (e.g., a smartphone), a computer device, a portable multimedia device, a mobile medical appliance, a camera, a wearable device, a home appliance, or the like. The electronic device according to an embodiment of the disclosure should not be limited to the above-mentioned devices.

It should be understood that various embodiments of the disclosure and terms used in the embodiments are not intended to limit technical features disclosed in the disclosure to the particular embodiment disclosed herein; rather, the disclosure should be understood to cover various modifications, equivalents, or alternatives of embodiments of the disclosure. With regard to description of drawings, similar or related components may be assigned with similar reference numerals. As used herein, singular forms of noun corresponding to an item may include one or more items unless the context clearly indicates otherwise. In the disclosure disclosed herein, each of the expressions "A or B", "at least one of A and B", "at least one of A or B", "A, B, or C", "one or more of A, B, and C", or "one or more of A, B, or C", and the like used herein may include any and all combinations of one or more of the associated listed items. The expressions, such as "a first", "a second", "the first", or "the second", may be used merely for the purpose of distinguishing a component from the other components, but do not limit the corresponding components in other aspect (e.g., the importance or the order). It is to be understood that if an element (e.g., a first element) is referred to, with or without the term "operatively" or "communicatively", as "coupled with," "coupled to," "connected with," or "connected to" another element (e.g., a second element), the element may be coupled with the other element directly (e.g., wiredly), wirelessly, or via a third element.

The term "module" used in the disclosure may include a unit implemented in hardware, software, or firmware or any combination thereof, and may be interchangeably used with the terms "logic", "logical block", "part" and "circuit". The "module" may be a minimum unit of an integrated part or may be a part thereof. The "module" may be a minimum unit for performing one or more functions or a part thereof. For example, according to an embodiment, the "module" may include an application-specific integrated circuit (ASIC).

Various embodiments of the disclosure may be implemented by software (e.g., the program) including an instruction stored in a machine-readable storage medium (e.g., an internal memory or an external memory) readable by a machine (e.g., the electronic device). For example, the processor (e.g., the processor) of a machine (e.g., the electronic device) may call the instruction from the machine-readable storage medium and execute the instructions thus called. This means that the machine may perform at least one function based on the called at least one instruction. The one or more instructions may include a code generated by a compiler or a code executable by an interpreter. The machine-readable storage medium may be provided in the form of non-transitory storage medium. Here, the "non-transitory storage medium is tangible, but does not include a signal (e.g., an electromagnetic wave). The term "non-transitory" does not differentiate a case where the data is permanently stored in the storage medium from a case where the data is temporally stored in the storage medium.

According to an embodiment, the method according to various embodiments disclosed in the disclosure may be provided as a part of a computer program product. The computer program product may be traded between a seller and a buyer as a product. The computer program product may be distributed in the form of machine-readable storage medium (e.g., a compact disc read only memory (CD-ROM)) or may be directly distributed (e.g., download or upload) online through an application store (e.g., a Play Store™) or between two user devices (e.g., the smartphones). In the case of online distribution, at least a portion of the computer program product may be temporarily stored or generated in a machine-readable storage medium such as a memory of a manufacturer's server, an application store's server, or a relay server.

According to various embodiments, each component (e.g., the module or the program) of the above-described components may include one or plural entities. According to various embodiments, at least one or more components of the above components or operations may be omitted, or one or more components or operations may be added. Alternatively or additionally, some components (e.g., the module or the program) may be integrated in one component. In this case, the integrated component may perform the same or similar functions performed by each corresponding components prior to the integration. According to various embodiments, operations performed by a module, a programming, or other components may be executed sequentially, in parallel, repeatedly, or in a heuristic method, or at least some operations may be executed in different sequences, omitted, or other operations may be added.

According to embodiments of the disclosure, a distance between an antenna module and a back cover may be maintained, and the antenna module may be fixed to an inner structure of a housing so as to be prevented from moving toward the back cover.

Besides, a variety of effects directly or indirectly understood through this disclosure may be provided.

While the disclosure has been illustrated and described with reference to various example embodiments thereof, it will be understood by those skilled in the art that various changes in form and details may be made therein without departing from the spirit and scope of the disclosure as may be defined, for example, by the appended claims and their equivalents.

What is claimed is:

1. An electronic device comprising:

a housing including a first plate facing a first direction, a second plate facing a second direction opposite the first direction, and a side housing surrounding a space between the first plate and the second plate, wherein the second plate includes an outer surface facing the second direction and being substantially flat and an inner surface facing the first direction and being substantially flat;

an inner plate interposed between the first plate and the second plate, wherein the inner plate includes a surface facing the inner surface of the second plate and an opening;

an antenna structure comprising a substrate facing the inner surface of the second plate and a second surface facing away from the inner surface, at least one conductive pattern on the first surface and/or embedded in the substrate, a first surrounding portion including a first hole penetrating the second surface, and a second surrounding portion including a second hole penetrating the second surface, the antenna structure being disposed in the opening;

a first support coupler including a first portion, least a portion of the first support coupler being located between the first surrounding portion and the first plate, and a first protrusion extending to an interior of the first hole;

a second support coupler including a second portion, least a portion of the second support coupler being located between the second surrounding portion and the first plate, and a second protrusion extending to an interior of the second hole; and a wireless communication circuit electrically connected to the conductive pattern and mounted on the second surface.

2. The electronic device of claim 1, wherein the wireless communication circuit is mounted on the second surface between the first surrounding portion and the second surrounding portion, when viewed from above the second surface.

3. The electronic device of claim 1, wherein the first support coupler is maintained by a first portion of the inner plate such that the first support coupler is configured to resist moving to the inner surface, and wherein the second support coupler is maintained by a second portion of the inner structure such that the second support coupler is configured to resist moving to the inner surface.

4. The electronic device of claim 3, wherein the first support coupler includes a first flange including a surface not overlapping the substrate and facing the inner surface, when viewed from above the second plate, and wherein the second support coupler includes a second flange including a surface not overlapping the substrate and facing the inner surface, when viewed from above the second plate.

5. The electronic device of claim 4, wherein the first portion of the inner plate includes a surface facing the first flange, and wherein the second portion of the inner plate includes a surface facing the second flange.

6. The electronic device of claim 1, wherein at least a portion of the first portion is larger in size than the first hole, and the second portion is larger in size than the second hole.

7. The electronic device of claim 4, further comprising:

an adhesive member comprising an adhesive material interposed between the surface of the first flange and the surface of the first portion of the inner plate.

8. The electronic device of claim 1, further comprising:

a printed circuit board interposed between the first plate and the inner plate, wherein the first support coupler and the second support coupler are disposed on the printed circuit board.

9. The electronic device of claim 1, wherein the side housing includes a first portion adjacent to the substrate of the antenna structure, and wherein the antenna structure is disposed adjacent to the side housing such that the first support coupler and the second support coupler are spaced from the first portion of the side housing by the same distance.

10. An electronic device comprising:

a housing including a first plate facing a first direction, a second plate facing a second direction opposite the first direction, and a side housing surrounding a space between the first plate and the second plate, wherein the second plate includes an outer surface facing the second direction and being substantially flat and an inner surface facing the first direction and being substantially flat;

an inner plate interposed between the first plate and the second plate, wherein the inner plate includes a surface facing the inner surface of the second plate and an opening;

an antenna structure comprising a substrate including a first surface facing the inner surface of the second plate and a second surface facing away from the inner surface, at least one conductive pattern on the first surface and/or embedded in the substrate, and at least one hole penetrating the second surface, the antenna structure being disposed in the opening;

at least one support coupler including a first portion at least partially located between the substrate and the first plate and a protrusion extending to an interior of the hole; and a wireless communication circuit electrically connected to the conductive pattern and mounted on the second surface.

11. The electronic device of claim 10, wherein the hole is provided around a region corresponding to the conductive pattern, of the second surface.

12. The electronic device of claim 10, wherein the hole penetrates the second surface and the first surface, and the hole penetrating the first surface is provided around a region corresponding to the conductive pattern.

13. The electronic device of claim 10, wherein the hole includes a first hole provided on one side of a region corresponding to the conductive pattern and a second hole provided on an opposite side thereof, wherein the support coupler includes a first support coupler including a first protrusion inserted into the first hole and a second protrusion inserted into the second hole, and wherein the first support coupler and the second support coupler are spaced from an inner surface of the side member by the same distance.

14. The electronic device of claim 10, wherein at least a portion of the support coupler includes a support surface supporting the second surface of the substrate, and wherein the protrusion extends from the support surface to an interior of the hole.

15. The electronic device of claim 10, wherein the protrusion is configured to be press-fitted in the hole, and wherein at least a portion of the protrusion protrudes in a direction facing an inner surface of the hole press an inner side surface of the hole.

16. The electronic device of claim 14, further comprising:

a printed circuit board disposed in the space between the first plate and the second plate; and a mid plate interposed between the printed circuit board and the second plate and in which at least one opening is formed, wherein the substrate is disposed in the opening, and wherein at least a portion of a surrounding region of the opening is supported by at least a portion of the support surface of the support coupler.

17. The electronic device of claim 16, wherein the side housing includes a first side defining an outer surface of the electronic device and a second side from the first side to the space, and wherein the printed circuit board is interposed between the second side and the second plate.

18. An electronic device comprising:

a housing including a first plate, a second plate facing away from the first plate, and a side housing surrounding a space between the first plate and the second plate;

an antenna substrate including a conductive pattern, a first surface including a radiation region through which an RF signal is radiated by the conductive pattern, a second surface facing away from the first surface, and a third surface located between the first surface and the second surface; and a bracket configured to fix the antenna substrate to the side member, wherein the side housing includes a first surface facing the first plate, a second surface facing the second plate, and a recess provided on the second surface, wherein the recess includes a first inner side wall, and a second inner side wall facing the first inner side wall and provided closer to an inside of the housing than the first inner side wall, wherein the antenna substrate is disposed in the recess such that the first surface faces the first inner side wall, the second surface faces the second inner side wall, and the third surface faces the second plate, wherein the bracket includes:

an insertion portion inserted between the second surface of the antenna substrate and the second inner side wall;

a support portion extending from the insertion portion and covering at least a portion of the third surface of the antenna substrate; and a fixing portion extending from the support portion and fixed to the second surface of the side member.

19. The electronic device of claim 18, further comprising:

a flexible printed circuit board (FPCB) including a heat radiator disposed on the second surface of the antenna substrate, a connector disposed on the second surface of the antenna substrate, and a correspondence connector coupled to the connector, wherein at least a portion of the FPCB is disposed in the recess, wherein the second inner side wall includes a first region corresponding to the heat radiator and a second region corresponding to the correspondence connector of the FPCB, and wherein the second region protrudes toward the second surface of the antenna substrate with respect to the first region, to press the correspondence connector toward the connector.

20. The electronic device of claim 18, wherein the first inner side wall includes protrusions contacting the first surface of the antenna substrate and a groove provided between the protrusions.

* * * * *